US012336599B2

(12) United States Patent
Filus

(10) Patent No.: US 12,336,599 B2
(45) Date of Patent: Jun. 24, 2025

(54) CLOTHING STRING CLIP THAT ATTACHES TO CLOTHING STRINGS

(71) Applicant: Drew Ian Filus, Studio City, CA (US)

(72) Inventor: Drew Ian Filus, Studio City, CA (US)

( * ) Notice: Subject to any disclaimer, the term of this patent is extended or adjusted under 35 U.S.C. 154(b) by 142 days.

(21) Appl. No.: 18/369,475

(22) Filed: Sep. 18, 2023

(65) Prior Publication Data

US 2024/0138522 A1 May 2, 2024

Related U.S. Application Data

(60) Provisional application No. 63/420,025, filed on Oct. 27, 2022.

(51) Int. Cl.
*A43C 7/00* (2006.01)

(52) U.S. Cl.
CPC ..... *A43C 7/00* (2013.01)

(58) Field of Classification Search
CPC ..... A43C 7/00; A43C 19/00; A43C 37/04; A43B 23/24; A62B 1/14; A44B 6/00; A44B 1/18; Y10T 24/14; Y10T 24/29; Y10T 24/3936; Y10T 24/3956; Y10T 24/3716; Y10T 24/39; A44C 17/0208; A44C 17/0225; A44C 17/0216; A44C 63/23; A44C 63/21; A44D 27/08
See application file for complete search history.

(56) References Cited

U.S. PATENT DOCUMENTS

| | | | | |
|---|---|---|---|---|
| 5,323,992 | A * | 6/1994 | Sifers | F16L 3/04 248/65 |
| 8,578,566 | B2 * | 11/2013 | Jolly | F16G 11/14 292/307 R |
| 2006/0207829 | A1 * | 9/2006 | Mauthner | B66D 3/10 182/5 |
| 2012/0193166 | A1 * | 8/2012 | Rogelja | A62B 1/14 182/5 |
| 2013/0032433 | A1 * | 2/2013 | Codega | A62B 1/14 182/5 |
| 2014/0262611 | A1 * | 9/2014 | Oddou | A62B 1/14 182/5 |
| 2015/0089975 | A1 * | 4/2015 | Paleschuck | G09F 23/00 63/1.13 |
| 2016/0228730 | A1 * | 8/2016 | Chaumontet | A62B 1/14 |
| 2018/0154190 | A1 * | 6/2018 | Chabod | A62B 1/14 |
| 2024/0424323 | A1 * | 12/2024 | Chabod | F16D 63/008 |

* cited by examiner

*Primary Examiner* — Jason W San
*Assistant Examiner* — Rowland Do
(74) *Attorney, Agent, or Firm* — H. Brock Kolls

(57) ABSTRACT

The present invention relates to a clothing string clip that attaches to clothing strings. A user pivots the rotatable hub, opening the front plate with respect to the back plate. The open position exposes a portion of the interior region including the contoured clothing string recessed channels. The user inserts a clothing string across the contoured clothing string recessed channels and into the clothing string channel. The user releases the top plate. The spring pivots the rotatable hub, aligning the top and back plates closed. In the closed position, the clothing string clip constricts and grips the clothing string within the contoured clothing string recessed channels and the clothing string channel, abating slipping of the clothing string clip along the clothing string during use, such as wearing, by the user. The user can press the front and back plates together to release the interlocked front and back tabs before opening.

23 Claims, 18 Drawing Sheets

CLOTHING STRING CLIP THAT ATTACHES TO CLOTHING STRINGS

CROSS-REFERENCE TO RELATED APPLICATIONS

This application contains subject matter which is related to the subject matter of the following co-pending application. The below-listed application is hereby incorporated herein by reference in its entirety:

This is a U.S. non-provisional application that claims the benefit of a U.S. provisional application, Ser. No. 63/420,025, inventor Drew Ian Filus, entitled "DECORATIVE CLIP TO ATTACH TO CLOTHING STRINGS", filed Oct. 27, 2022.

TECHNICAL FIELD OF THE INVENTION

This invention relates to a clothing string clip that attaches to clothing strings. A user pivots the rotatable hub, opening the front plate with respect to the back plate. The open position exposes a portion of the interior region including the contoured clothing string recessed channels. The user inserts a clothing string across the contoured clothing string recessed channels and into the clothing string channel. The user releases the top plate. The spring pivots the rotatable hub, aligning the top plate and the back plate closed. In the closed position, the clothing string clip constricts and friction grips the clothing string within the contoured clothing string recessed channels and the clothing string channel, abating slipping of the clothing string clip along the clothing string during use, such as wearing, by the user.

BACKGROUND OF THE INVENTION

Before our invention clothing strings such as those on hoodies, sweatpants, sweatshirts, shorts, backpacks, and other items were highly visible but from a fashion perspective mostly ignored. Their intended purpose is most often associated with cinching, closings, or otherwise tightening an opening such as on pants, a hood, or other openings.

A shortcoming with clothing strings is that while they are sized to encompass the circumference of an opening often they can be pulled one way or the other causing one end of the clothing string to ingress into the item rendering it unreachable by the user.

Another shortcoming with clothing strings can be their length which can hang down from an item in an excessive length and/or undesirable manner, or become wadded up such as when tying two ends into a bow which can be bulky and unattractive looking. In both cases, while the functionality of the clothing strings has a purpose there are limited options for managing the loose end of the clothing strings while at the same time enhancing the fashion look of the item being worn by the user.

The present invention addresses these and other shortcomings by providing a clothing string clip that attaches to clothing strings and provides other advantages. For these reasons and shortcomings as well as other reasons and shortcomings there is a long-felt need that gives rise to the present invention.

SUMMARY OF THE INVENTION

The shortcomings of the prior art are overcome and additional advantages are provided through the provision of a clothing string clip that attaches to clothing strings. The clothing string clip comprises more than one raised clothing string ridge having a contoured clothing string recessed channel along a portion of the peak of the raised clothing string ridge.

The clothing string clip also comprises a front plate having a mounting slot, and a hub hole. The back side of the front plate comprises at least one front tab, at least one clothing string channel, at least one raised spring ridge forming a spring recess, and more than one raised clothing string ridge. At least one of the raised clothing string ridges is positioned on each side of the clothing string channel.

The clothing string clip also comprises a back plate having an insert hole. The back side of the back plate comprises at least one back tab, at least one clothing string channel pressure tab, a spring seat, and more than one raised clothing string ridge. At least one of the raised clothing string ridges is positioned on each side of the clothing string channel pressure tab.

The clothing string clip also comprises an insert that can be fitted into the insert hole and a spring that can be positioned on the spring seat and fitted into the spring recess. A fastener passes through the hub hole and fastens with the insert securing the front plate and the back plate together forming a rotatable hub. The back side of the front plate and the back side of the back plate are opposed forming an interior region.

In operation, a user pivots the rotatable hub, opening the front plate with respect to the back plate. In the open position, a portion of the interior region is exposed including at least the contoured clothing string recessed channels. The user inserts a clothing string across the contoured clothing string recessed channels and into the clothing string channel. The user releases the top plate. The spring pivots the rotatable hub, aligning the top plate and the back plate closed. In the closed position, the clothing string clip constricts and friction grips the clothing string within the contoured clothing string recessed channels and the clothing string channel, abating slipping of the clothing string clip along the clothing string during use by the user.

Additional shortcomings of the prior art are overcome and additional advantages are provided through the provision of a method of using a clothing string clip that attaches to clothing strings. The method comprises the step of opening the clothing string clip by way of a user pivoting a rotatable hub. The clothing string clip comprises more than one raised clothing string ridge having a contoured clothing string recessed channel along a portion of the peak of the raised clothing string ridge. A front plate has a mounting slot and a hub hole. The back side of the front plate comprises at least one front tab, at least one clothing string channel, at least one raised spring ridge forming a spring recess, and more than one raised clothing string ridge. At least one of the raised clothing string ridges is positioned on each side of the clothing string channel. A back plate has an insert hole. The back side of the back plate comprises at least one back tab, at least one clothing string channel pressure tab, a spring seat, and more than one raised clothing string ridge. At least one of the raised clothing string ridges is positioned on each side of the clothing string channel pressure tab. An insert is fitted into the insert hole, and a spring is positioned on the spring seat and fitted into the spring recess. A fastener passes through the hub hole and fastens with the insert securing the front plate and the back plate together forming the rotatable hub. The back side of the front plate and the back side of the back plate are opposed forming an interior region.

In operation, the user opens the front plate with respect to the back plate. In the open position, a portion of the interior region is exposed including at least the contoured clothing string recessed channels.

The method continues by positioning, by way of the user, a clothing string across the contoured clothing string recessed channels and into the clothing string channel. And, securing the clothing string clip to the clothing string when the user releases the top plate, allowing the spring to pivot the rotatable hub, aligning the top plate and the back plate closed. In the closed position, the clothing string clip constricts and friction grips the clothing string within the contoured clothing string recessed channels, and the clothing string channel pressure tab aligns within the clothing string channel, retaining the clothing string within the clothing string channel and applying pinch pressure to the clothing string against the back side of the front plate by way of the clothing string channel pressure tab, abating slipping of the clothing string clip along the clothing string during use by the user.

Additional shortcomings of the prior art are overcome and additional advantages are provided through the provision of a clothing string clip that attaches to clothing strings. The clothing string clip comprises more than one raised clothing string ridge having a contoured clothing string recessed channel along a portion of the peak of the raised clothing string ridge.

The clothing string clip also comprises a front plate having a mounting slot, and a hub hole. The back side of the front plate comprises at least one front tab, at least one clothing string channel, at least one raised spring ridge forming a spring recess, and more than one raised clothing string ridge. At least one of the raised clothing string ridges is positioned on each side of the clothing string channel.

The clothing string clip also comprises a back plate having an insert hole. The back side of the back plate comprises at least one back tab, at least one clothing string channel pressure tab, a spring seat, and more than one raised clothing string ridge. At least one of the raised clothing string ridges is positioned on each side of the clothing string channel pressure tab.

The clothing string clip also comprises an insert that can be fitted into the insert hole and a spring that can be positioned on the spring seat and fitted into the spring recess. A fastener passes through the hub hole and fastens with the insert securing the front plate and the back plate together forming a rotatable hub. The back side of the front plate and the back side of the back plate are opposed forming an interior region. An emblem is secured by way of the mounting slot to the outer surface of the front plate.

In operation, a user pivots the rotatable hub, opening the front plate with respect to the back plate. The open position exposes a portion of the interior region including at least the contoured clothing string recessed channels. The user inserts a clothing string across the contoured clothing string recessed channels and into the clothing string channel. The user releases the top plate. The spring pivots the rotatable hub, aligning the top plate and the back plate closed. In the closed position, the front tab and the back tab interlock in a removable manner pulling the front plate and the back plate together. The clothing string clip constricts and friction grips the clothing string within the contoured clothing string recessed channels, and the clothing string channel pressure tab aligns within the clothing string channel, retaining the clothing string within the clothing string channel and applying pinch pressure to the clothing string against the back side of the front plate by way of the clothing string channel pressure tab, abating slipping of the clothing string clip along the clothing string during use by the user.

Additional features and advantages are realized through the techniques of the present invention. Other embodiments and aspects of the invention are described in detail herein and are considered a part of the claimed invention. For a better understanding of the invention with advantages and features, refer to the description and the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1:
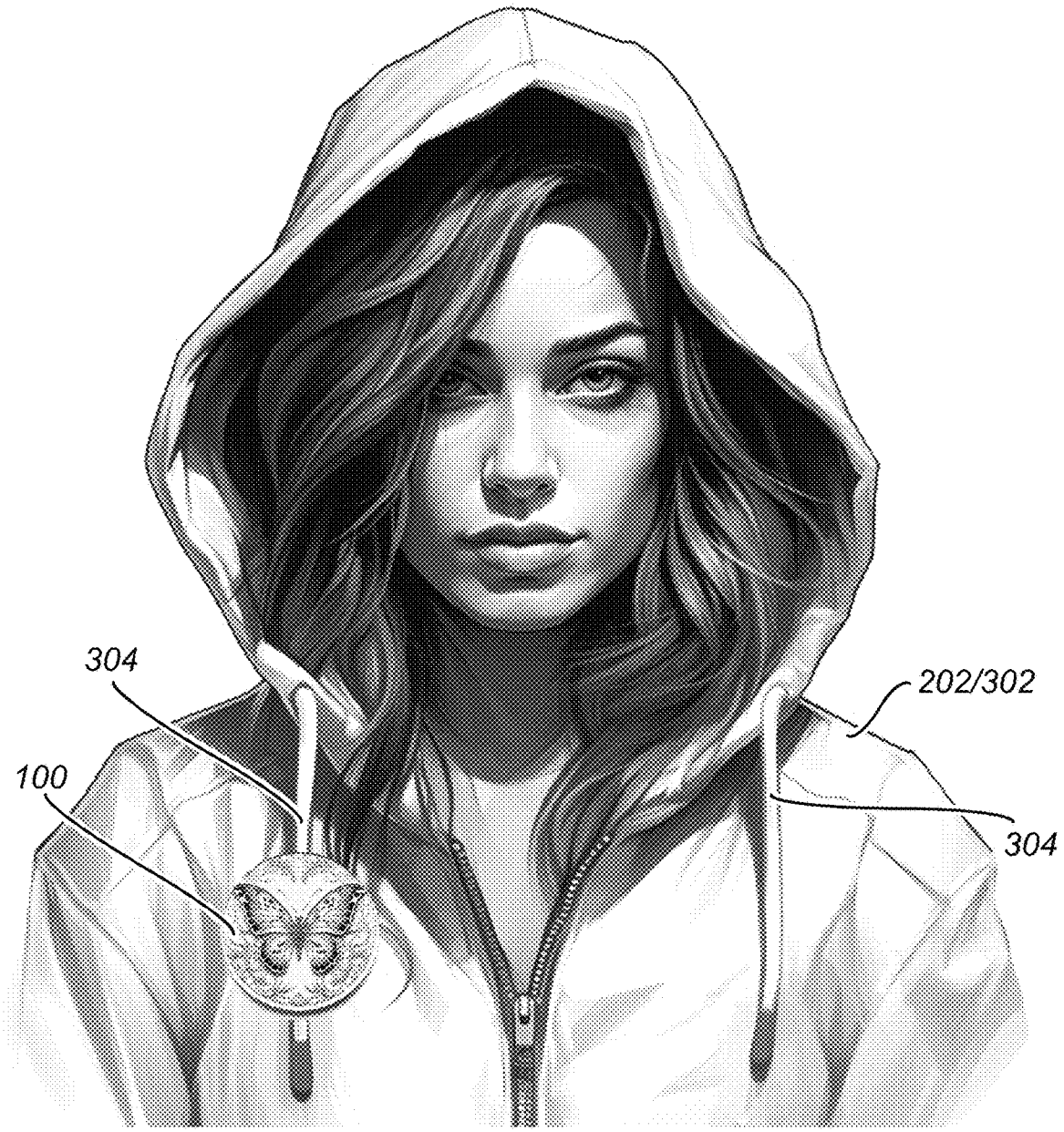
FIGS. 1-3 illustrate examples of a user wearing a clothing string clip on a clothing string.
Figure 2:
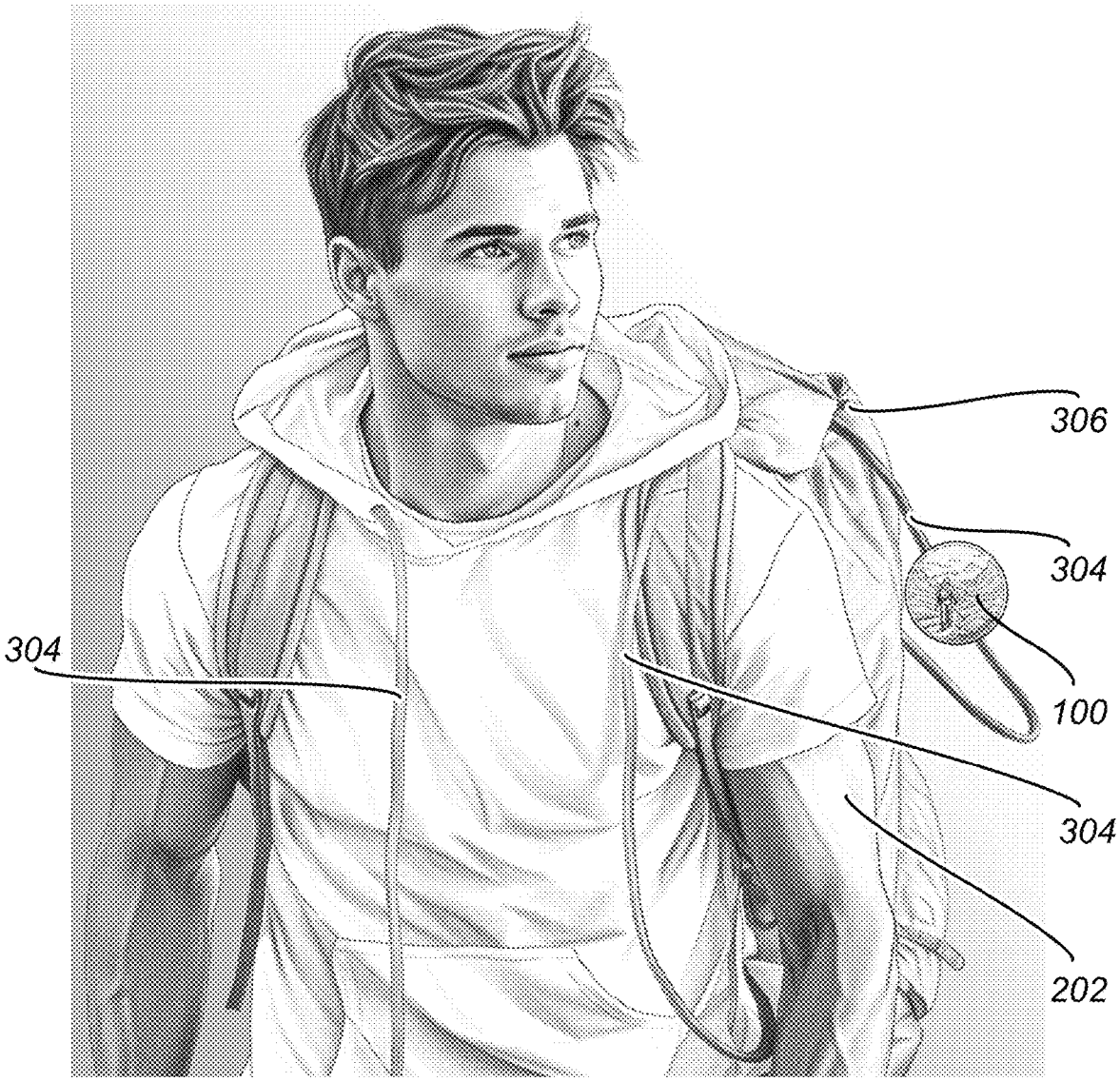
Figure 3:
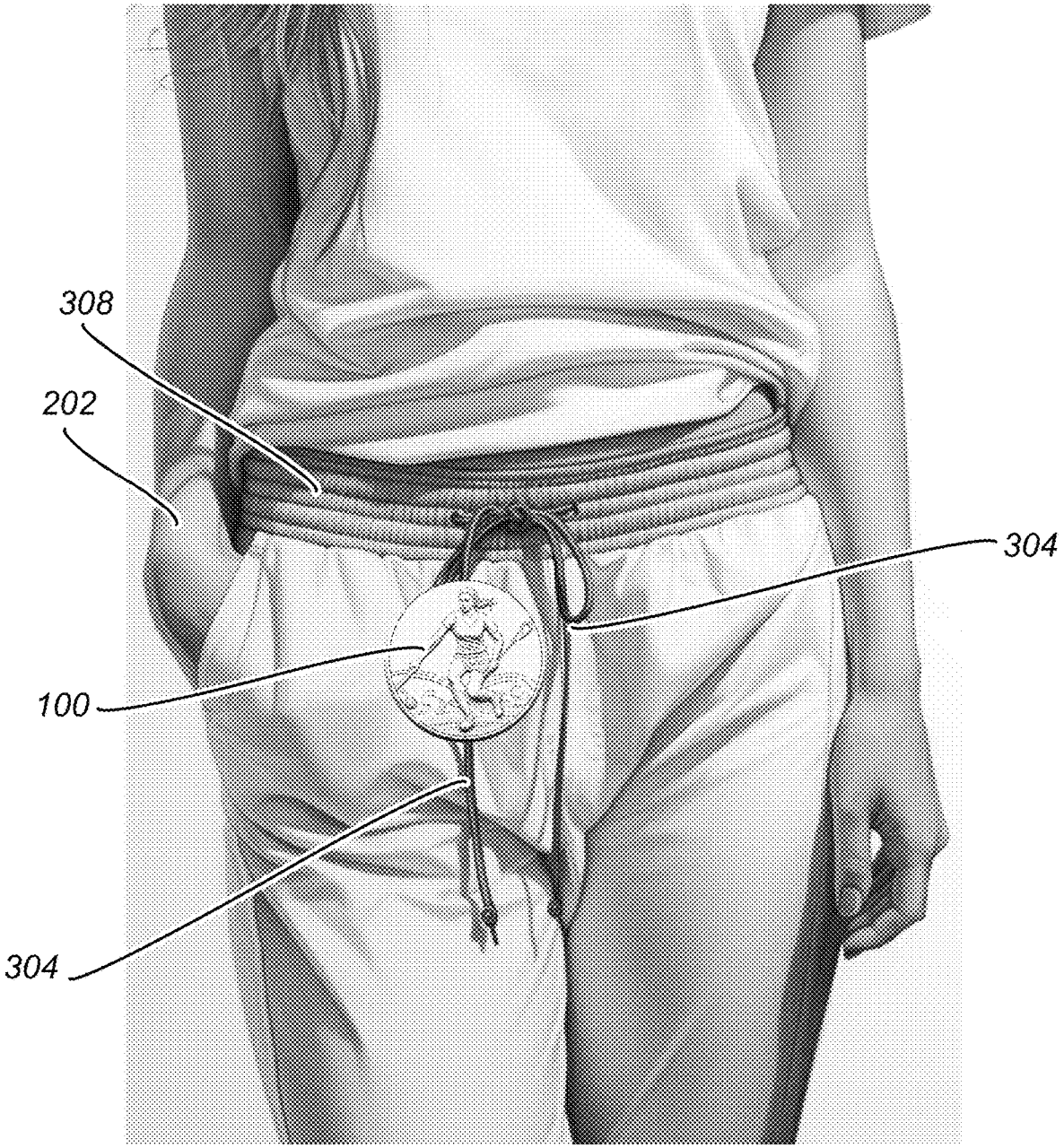

Turning now to the drawings in greater detail, it will be seen that in FIGS. 1 through 3 there are illustrated examples of user 202 wearing or otherwise using a clothing string clip 100 on a clothing string 304. In an exemplary embodiment, in FIG. 1, a user 202 is illustrated wearing outerwear 302. Such outerwear 302 can be a hoodie, a windbreaker, a jacket, a coat, a sweatshirt, a shirt, or other types and/or kinds of outerwear 302 without limitation. Such outerwear 302 can comprise clothing strings 304 which can also be referred to as drawstrings. Such clothing strings 304 can be proximate to a hood as a way to cinch tight around the head of user 202, around the waist of the jacket to cinch tight around the waist of user 202, or located in other positions in the outerwear 302 as may be required and/or desired in a particular embodiment.

In an exemplary embodiment, a clothing string clip 100 can be attached or otherwise interconnected with the clothing string 304. Any number of clothing string clip 100 can be added to a clothing string 304. Additionally, clothing string clip 100 can be added to more than one of the clothing strings 304 as many garments may have two or more as illustrated in at least FIG. 1.

An advantage, in the present invention, is that the clothing string clip 100 while managing the loose end of clothing string 304 from being pulled or otherwise ingress backward into the clothing where the end is no longer accessible, the clothing string clip 100 also acts as a display platform for fashionable emblems 102, charms, jewelry, and other items collectively referred to as emblems 102 for disclosure purposes. In this regard, user 202 can select emblem 102 of all types that can be interconnected with the clothing string clip 100 and worn by user 202. Such emblems 102 can be decorative, accomplishment-related, inspirational, or meaningful to the user 202 in other ways without limitation. As an example, and not a limitation, the clothing string clip 100 in FIG. 1 comprises an emblem 102 that is the imagery of a butterfly, FIG. 2 comprises an emblem 102 that is the imagery of an outdoorsman, and FIG. 3 comprises an emblem 102 that is the imagery of sports. In general, in addition to being functional in managing the loose ends of clothing strings 340, the present invention also adds considerable fashion STRINGBLING to user 202 outfits.

In an exemplary embodiment, the clothing string clip 100 can be fabricated from plastic, metal, rubber, a combination thereof, and/or other suitable materials as may be required and/or desired in a particular embodiment. Additionally, in an exemplary embodiment, the clothing string clip 100 can be circular in shape, or other suitable shapes as may be required and or desired in a particular embodiment, In an exemplary embodiment, the clothing string clip 100 and emblem 102 can be fabricated in different shapes and sizes. Additionally, and with reference to at least FIG. 17, the emblems can be different shapes than the clothing string clip 100, even shapes that are larger than the clothing string clip 100 as long as the emblems 102 are configured to fasten to the front plate 112 and/or back plate 104, FIG. 17 reference 'A' is one example. Furthermore, emblems 102 can be configured to be secured to the front plate 112 and/or back plate 104 in a permanent manner or temporary manner allowing user 202 to interchange the emblems 102, as may be required and/or desired in a particular embodiment.

Referring to FIG. 2 there is illustrated user 202 wearing a clothing string clip 100 on a clothing string 304 that is part of a backpack 306. In this regard, the clothing string clip 100 can be attached to the clothing string 304 that is associated with backpack 306 or other types and/or kinds of purses, backpacks, or other carry items having clothing strings 304. In a plurality of exemplary embodiments, clothing string clip 100 can be interconnected or otherwise attached to all types of clothing strings/drawstrings 304 that a user 202 might use or wear even if only worn or carried intermittently such as a backpack 306, hat, glasses, beanie, or other types and/or kinds of items as may be required and/or desired in a particular embodiment.

Referring to FIG. 3 there is illustrated one example of user 202 wearing a clothing string clip 100 on a clothing string 304 that is part of pants 306. In an exemplary embodiment, the clothing string clip 100 can be worn on drawstring types of pants such as sweat pants, other types of pants, shoelaces, and other types and kinds of clothing without limitation.

Figure 4:
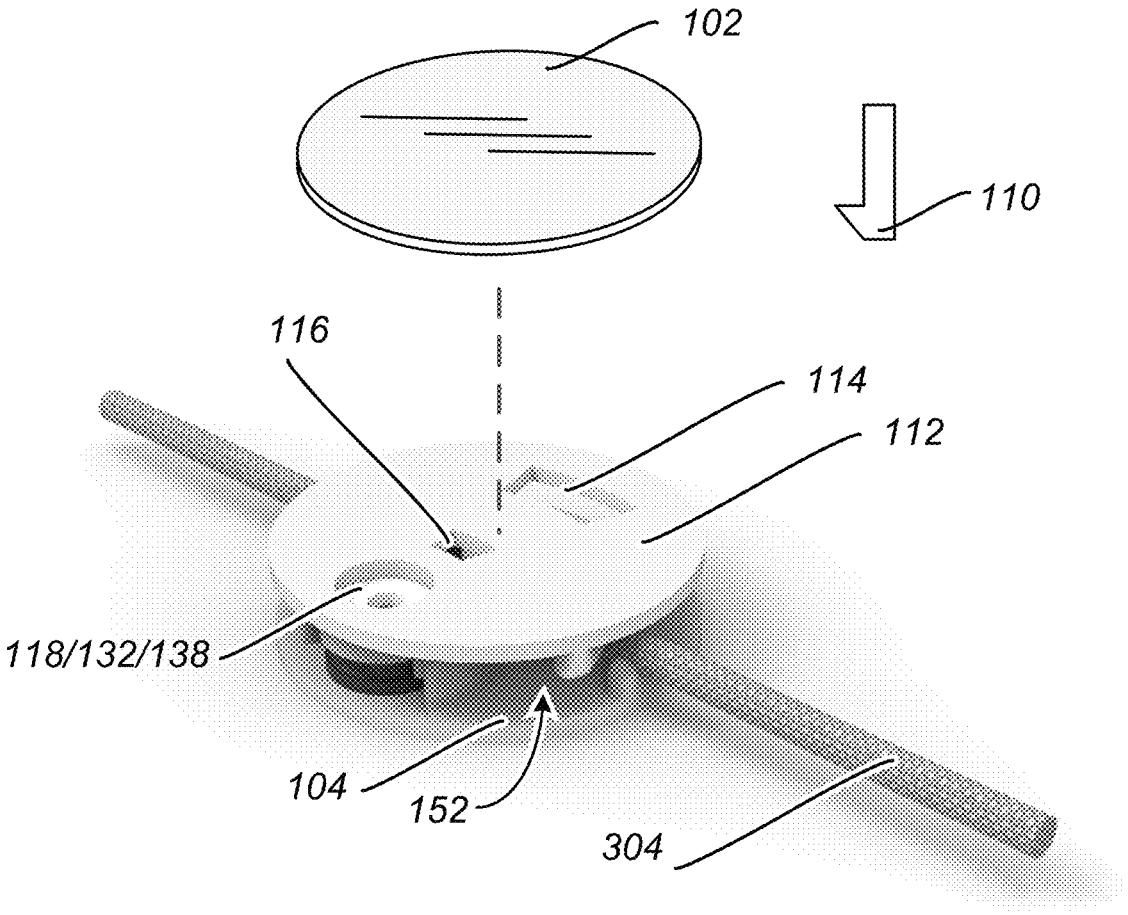
FIGS. 4-5 illustrate one example of a perspective view of a clothing string clip in the closed or locked position around a clothing string.

Referring to FIG. 4 there is illustrated one example of a perspective view of a clothing string clip 100 in the closed or locked position around a clothing string 304. In an exemplary embodiment, user 202 can pivot 404 the rotatable hub 118/132/136 opening the front plate 112 with respect to the back plate 104, as better illustrated in at least FIG. 6. In the open position, a portion of the interior region 152 is exposed including at least the contoured clothing string recessed channels 126/160/164/172 which are better illustrated in at least FIGS. 9 and 10. Once opened user 202 can insert a clothing string 304 across the contoured clothing string recessed channels 126/160/164/172 and into the clothing string channel 166.

In an exemplary embodiment, the rotatable hub is formed by the assembly of fastener 118, spring 132, and insert 136 along with the front plate 112 and the back plate 104. This assembly is better illustrated in at least FIG. 8. For disclosure purposes, the rotatable hub can be referred to as rotatable hub 118/132/136. In operation, spring 132 tightens when the rotatable hub 118/132/136 is pivoted open by the user and the spring aids in applying a rotational force to pivot the rotatable hub 118/132/136 closed when released by the user aligning the front plate 112 with the back plate 104.

With reference to FIG. 4, as user 202 releases the top plate 112 the spring 132 pivots the rotatable hub 118/132/136, aligning the top plate 112 and the back plate 104 closed. In the closed position, the clothing string clip 100 constricts and friction grips the clothing string 304 within the contoured clothing string recessed channels 126/160/164/172 and clothing string channel 166, abating slipping of the clothing string clip 100 along the clothing string 304 during use, such as wearing, by user 202.

The term "friction grip", in the present invention, is intended to mean two or more surfaces pressed close together with the clothing string 304 therebetween. The action of pinching increases the friction and creates a grip between the contacting surfaces and the clothing spring 304. This can be referred to as a friction grip. In the present invention, an exemplary embodiment of friction grip can be when the clothing string clip 100 constricts and friction grips the clothing string 304 between the contacting surfaces which are the contoured clothing string recessed channels 126/160/164/172.

Figure 5:
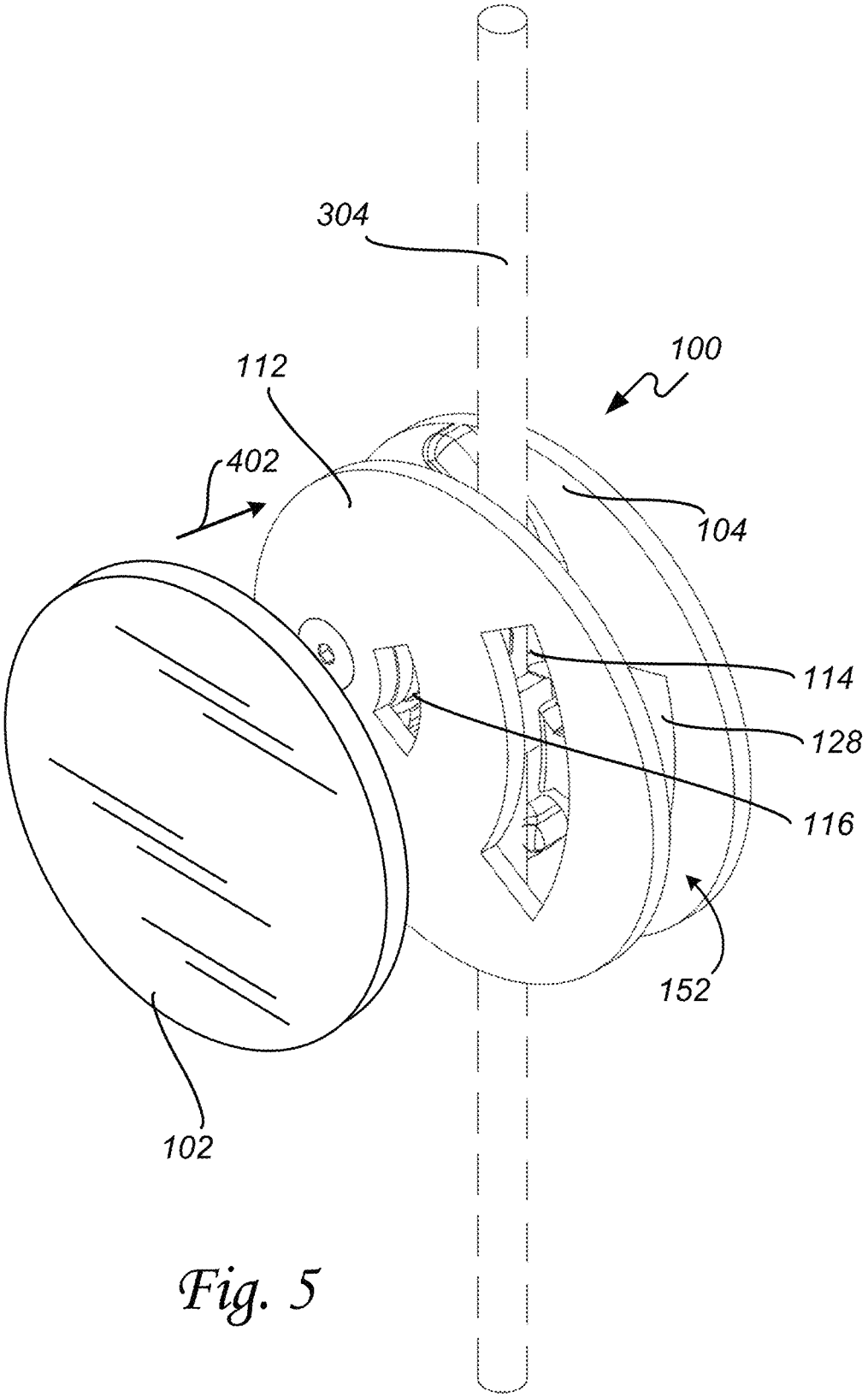

Referring to FIG. 5 there is illustrated one example of a perspective view of a clothing string clip 100 in the closed or locked position around a clothing string 304.

In an exemplary embodiment, an emblem 102 can be secured, fastened, or otherwise interconnected 402 to the outer surface of the front plate 112 by way of the mounting slot 114. The mounting slot 114 can be curvilinear in shape to follow the perimeter of the front plate 112.

In another exemplary embodiment, an emblem 102 can be secured, fastened, or otherwise interconnected 402 to the outer surface of the front plate 112 by way of the mounting slot 114 and an orientation slot 116. The front plate 113 comprises the orientation slot 116. In this regard, orientation slot 116 can better ensure that emblem 102 is connected by at least two points (the mounting slot 114 and the orientation slot 116) and that emblem 102 is orientated correctly on the surface of the front plate 112.

Figure 10:
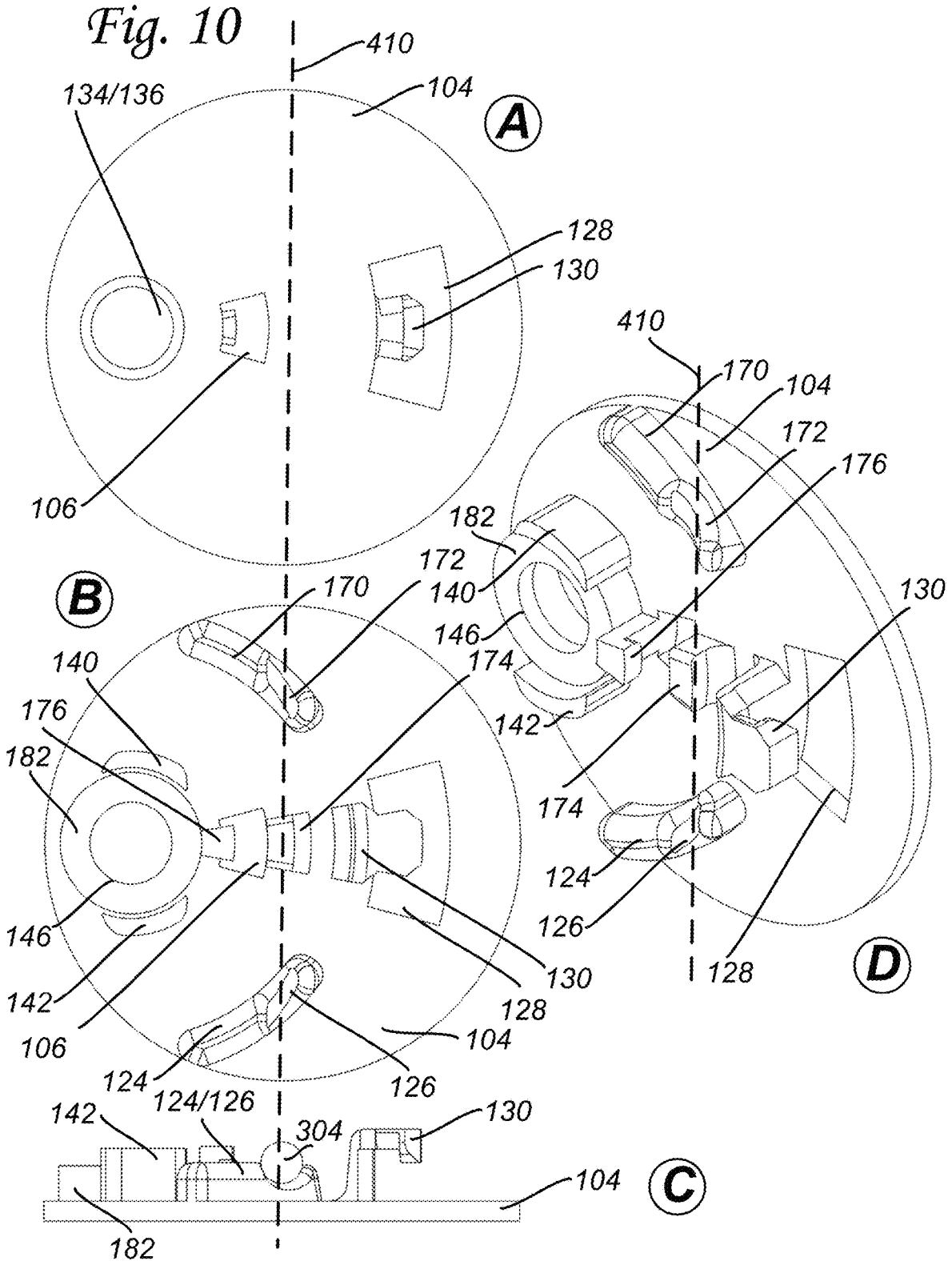
FIG. 10 illustrates one example of a front view, a back view, a bottom view, and a perspective view of a back plate.

In another exemplary embodiment and as better illustrated in at least FIG. 10, the back plate 104 can comprise a back mounting slot 128 where emblem 102 can be secured, fastened, or otherwise interconnected on the back plate 104.

The back mounting slot 128 can be curvilinear in shape to follow the perimeter of the back plate 104.

In another exemplary embodiment, the back plate 104 can comprise a back mounting slot 128 and a back orientation slot 106 where emblem 102 can be secured, fastened, or otherwise interconnected on the back plate 104. In this regard, back orientation slot 106 can better ensure that emblem 102 is connected by at least two points (the back mounting slot 128 and the back orientation slot 106) and that emblem 102 is orientated correctly on the surface of the back plate 104.

Figure 6:
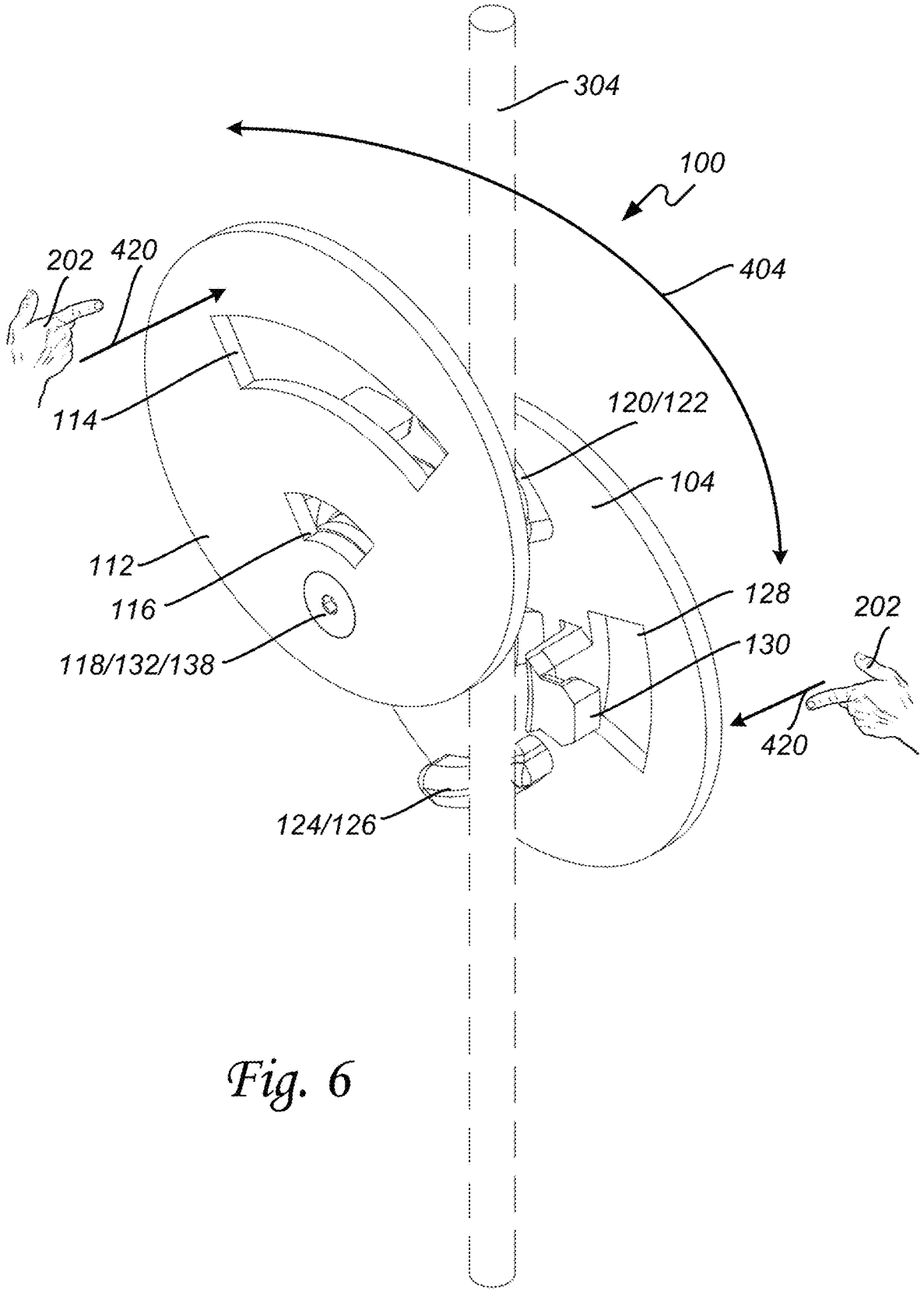
FIG. 6 illustrates one example of a perspective view of a clothing string clip in the open or unlocked position.
Figure 7:
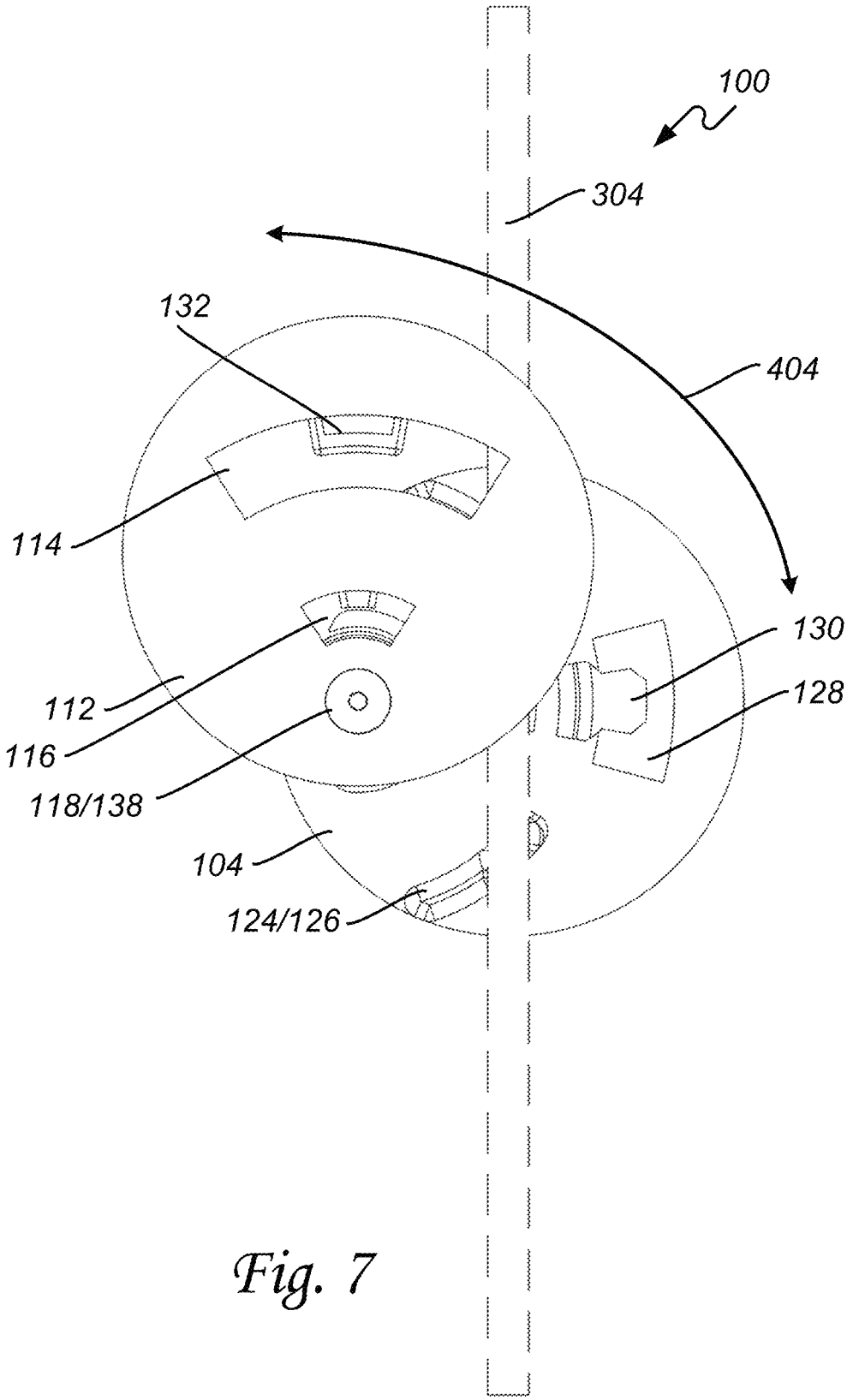
FIG. 7 illustrates one example of a front view of a clothing string clip in the open or unlocked position.

Referring to FIG. 6 there is illustrated one example of a perspective view of a clothing string clip 100 in the open or unlocked position. And, referring to FIG. 7 there is illustrated one example of a front view of a clothing string clip 100 in the open or unlocked position.

Figure 8:
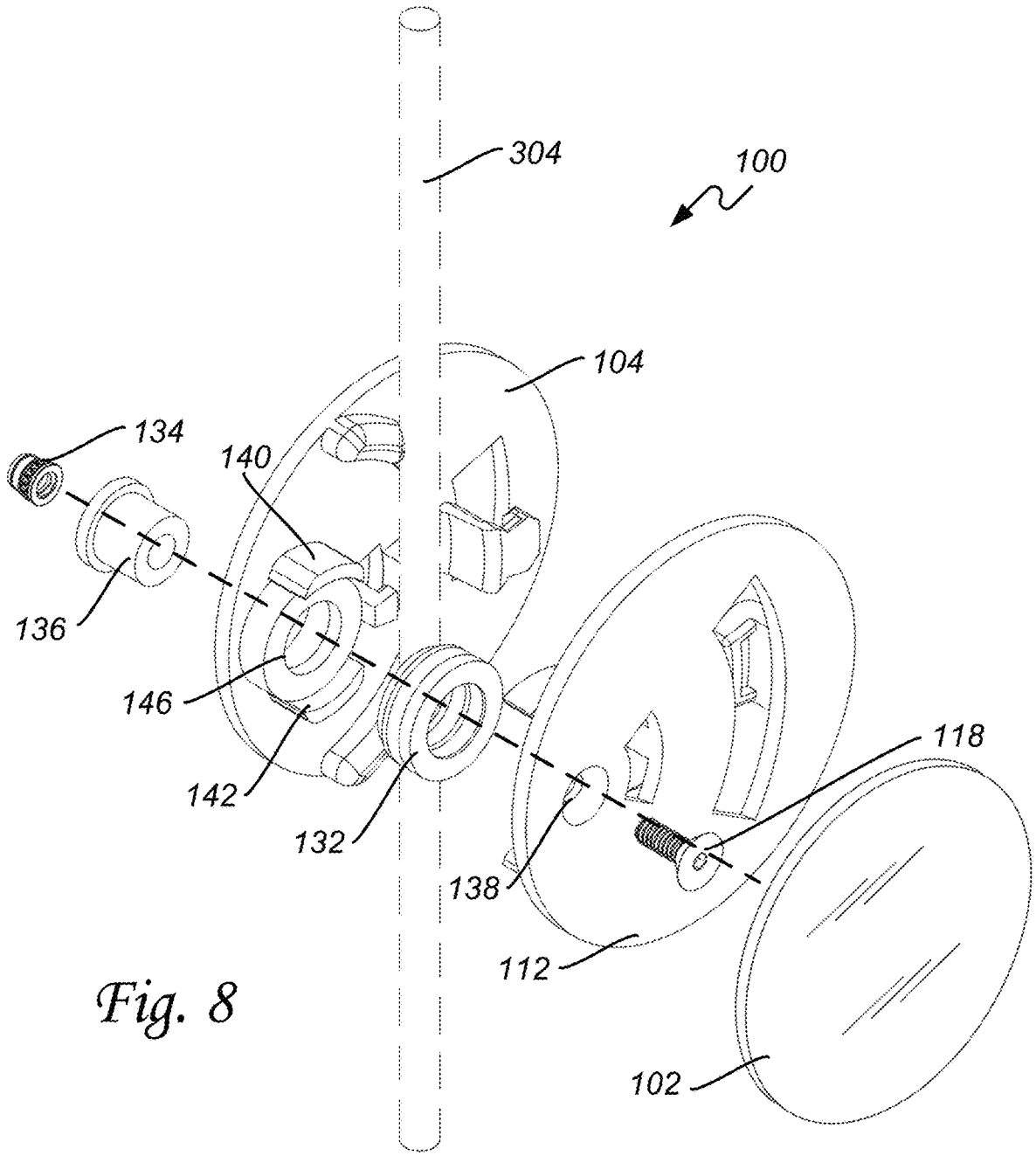
FIG. 8 illustrates one example of a disassembled view of a clothing string clip.

In an exemplary embodiment, the clothing string clip 100 can be opened or otherwise unlocked by way of a user 202 pivoting 404 around the rotatable hub 118/132/136, as better illustrated in at least FIG. 8. The rotatable hub 118/132/136 can be formed by fastener 118 passing through the hub hole 138 on the front plate 112, then insert 136 passes through the back plate 104 insert hole 146, the insert 136 then passes through spring 132 and the assembly secured together by the interconnection of fastener 118 and insert 136. Insert 136 can have a threaded insert 134 to grip the fastener 118. The front plate 112 and back plate 104 are secured together in a manner that allows the front plate 112 to pivot 404 open and closed with respect to the back plate 104 so that user 202 can insert or remove a clothing string 304 from the interior 152 of the clothing string clip 100.

In an exemplary embodiment, fastener 118 can be a screw, rivet, or other suitable fastener as may be required and or desired in a particular embodiment. The insert 136 can be plastic, metal, or other suitable material. The threaded insert 134 can be metal or other suitable material and be pressed or molded into the insert 136 as may be required and/or desired in a particular embodiment.

An advantage, in the present invention, is a press-to-release feature. In this regard, in an exemplary embodiment, when the clothing string clip 100 is in the closed position the front tab 108 and the back tab 130 interlock. To disengage and unlock the front tab 108 and back tab 130 so that the clothing clip 100 can be opened, the user in a press-to-release manner 420 can press the front plate 112 and the back plate 104 closer together while pivoting 404 the front plate 112 with respect to the back plate 104 to open the clothing clip 100 exposing a portion of the interior region 152. Such press-to-release feature in the present invention prevents inadvertent opening of the clothing string clip 100 and also adds a child-proof type of lock feature for safety around young kids.

Figure 9:
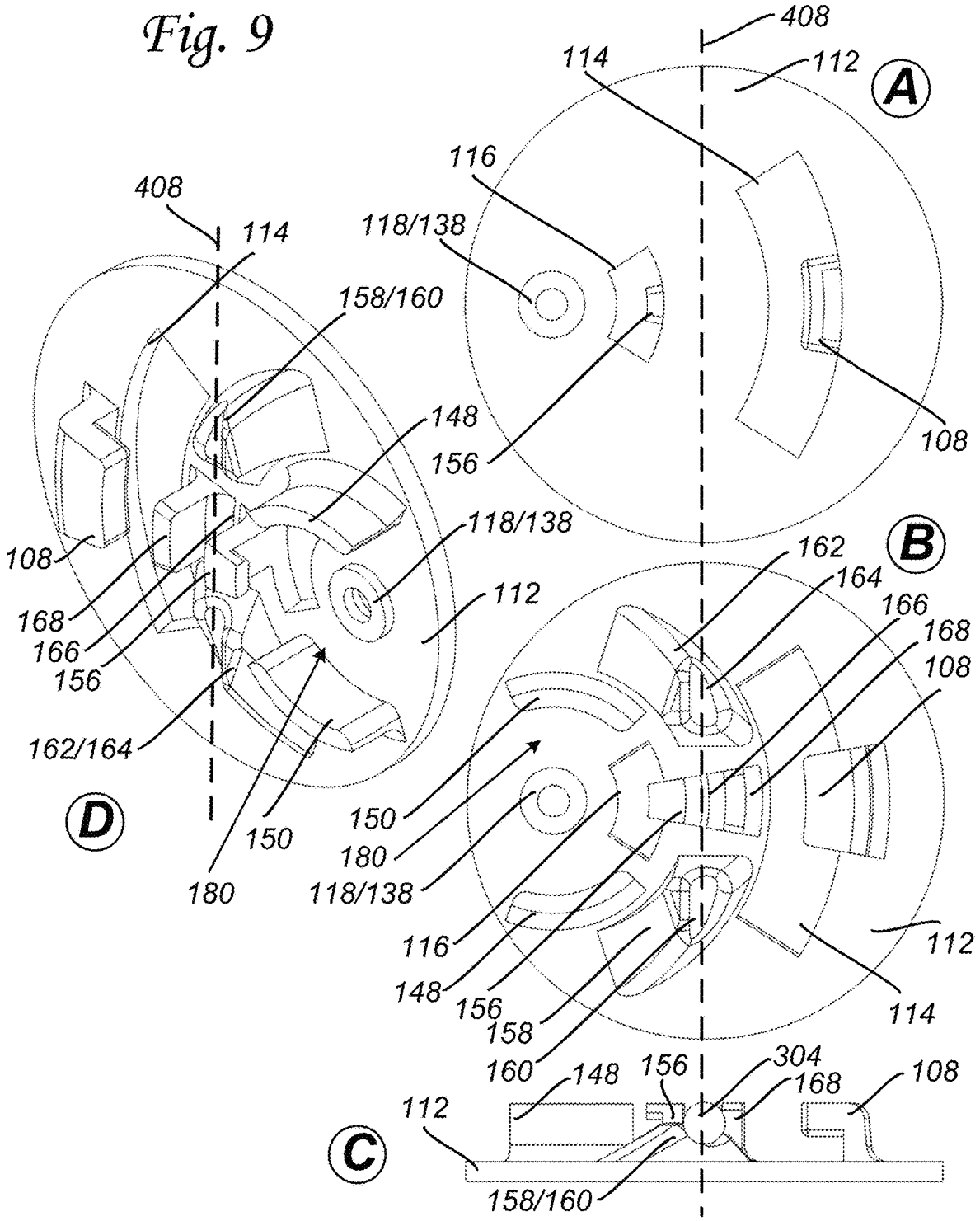
FIG. 9 illustrates one example of a front view, a back view, a bottom view, and a perspective view of a front plate.

Referring to FIG. 8 there is illustrated one example of a disassembled view of a clothing string clip 100. Referring to FIG. 9 there is illustrated one example of a front view in reference 'A', a back view in reference 'B', a bottom view in reference 'C', and a perspective view in reference 'D' of the front plate 112. Referring to FIG. 10 there is illustrated one example of a front view in reference 'A', a back view in reference 'B', a bottom view in reference 'C', and a perspective view in reference 'D' of the back plate 104.

In an exemplary embodiment and with reference to at least FIGS. 8, 9, and 10, the clothing string clip 100 attaches to a clothing string 304. In this regard, the clothing string clip 100 can comprise more than one raised clothing string ridge 124/158/162/170. The raised clothing string ridge 124/158/162/170 can have contoured clothing string recessed channels 126/160/164/172 along a portion of the peak of the raised clothing string ridge 124/158/162/170. The clothing string clip 100 can also comprise a front plate 112 that has a mounting slot 114, and a hub hole 138. The back side of the front plate 112 can comprise at least one front tab 108, at least one clothing string channel 166, at least one raised spring ridge 148/150 forming a spring recess 180, and more than one raised clothing string ridge 158/162. At least one of the raised clothing string ridges 158/162 is positioned on each side of the clothing string channel 166.

In an exemplary embodiment, the clothing string channel 166 on the back side of the front plate 112 can be formed between a front plate channel tab 168 and one of the front tab 156 which are positioned proximate to each other with a gap therebetween which creates the clothing string channel 166. In operation, there can be more than one front tab 108/156 and more than one back tab 130/176 as may be required and/or desired in a particular embodiment.

The clothing string clip 100 can also comprise a back plate 104 that has an insert hole 146. The back side of the back plate 104 can comprise at least one back tab 130, at least one clothing string channel pressure tab 174, a spring seat 140/142/182, and more than one raised clothing string ridge 124/170. At least one raised clothing string ridge 124/170 is positioned on each side of the clothing string channel pressure tab 174. An insert 136 is fitted into the insert hole 146. In operation, the spring seat 140/142/182 can comprise a raised ring 182 sized in diameter and thickness to allow the spring 132 to fit snuggly within the rotatable hub assembly between the front plate 112 and the back plate 104, and more than one perimeter ring 140/142 to keep the spring 132 in position atop the raised ring 182.

The clothing string clip 100 can also comprise the spring 132 that is positioned on the spring seat 140/142/182 and fitted into the spring recess 180. A fastener 118 passes through the hub hole 138 and fastens with the insert 136 securing the front plate 112 and the back plate 104 together forming a rotatable hub 118/132/136. The back side of the front plate 112 and the back side of the back plate 104 are opposed forming an interior region 152.

In an exemplary embodiment, the diameter of the spring seat 140/142/182 can be configured to fit within the diameter of the spring recess 180 retaining the spring 132 therein when the front plate 112 and back plate 104 are fastened together. In this regard, spring 132 is captured within the spring recess 180 and contained within the boundaries of the spring seat 140/142/182.

In an exemplary embodiment, the spring 132 can be fabricated from rubber, plastic, metal, a combination thereof, or other suitable materials as may be required and/or desired in a particular embodiment.

In operation, user 202 can pivot 404 the rotatable hub 118/132/136 opening the front plate 112 with respect to the back plate 104. In the open position, the interior region 152 is exposed including at least the contoured clothing string recessed channels 126/160/164/172. User 202 can insert a clothing string 304 across the contoured clothing string recessed channels 126/160/164/172 and into the clothing string channel 166. Once the clothing string 304 has been inserted as mentioned above, user 202 can release the top plate 112, the spring 132 pivots 404 the rotatable hub 118/132/136, aligning the top plate 112 and the back plate 104 in a closed position. In the closed position, the clothing string clip 100 constricts and friction grips the clothing string 304 within the contoured clothing string recessed channels 126/160/164/172 and clothing string channel 166, abating slipping of the clothing string clip 100 along the clothing string 304 during use by user 202.

Use by user 202 can include, as an example and not a limitation, wearing or carrying an article with clothing strings 304 such as clothing, backpacks, and other articles as may be required and/or desired in a particular embodiment.

In an exemplary embodiment, when the clothing string clip 100 is in the closed position, such as illustrated in at least FIG. 4, the contoured clothing string recessed channels 126/160/164/172 on the top plate 112 and back plate 104 are aligned along a central reference line 408 as illustrated in at least FIG. 8 allowing the clothing string 304 to pass in a gripping manner centrally through the interior region 152 of the clothing string clip 100.

Additionally, the raised clothing string ridges 124/158/162/170 and the contoured clothing string recessed channels 126/160/164/172 are offset with respect to each other between the front plate 112 and back plate 104 so that in operation they don't bind or otherwise interfere with the pivoting 404 and gripping action of the clothing string clip 100 during use.

Figure 11:
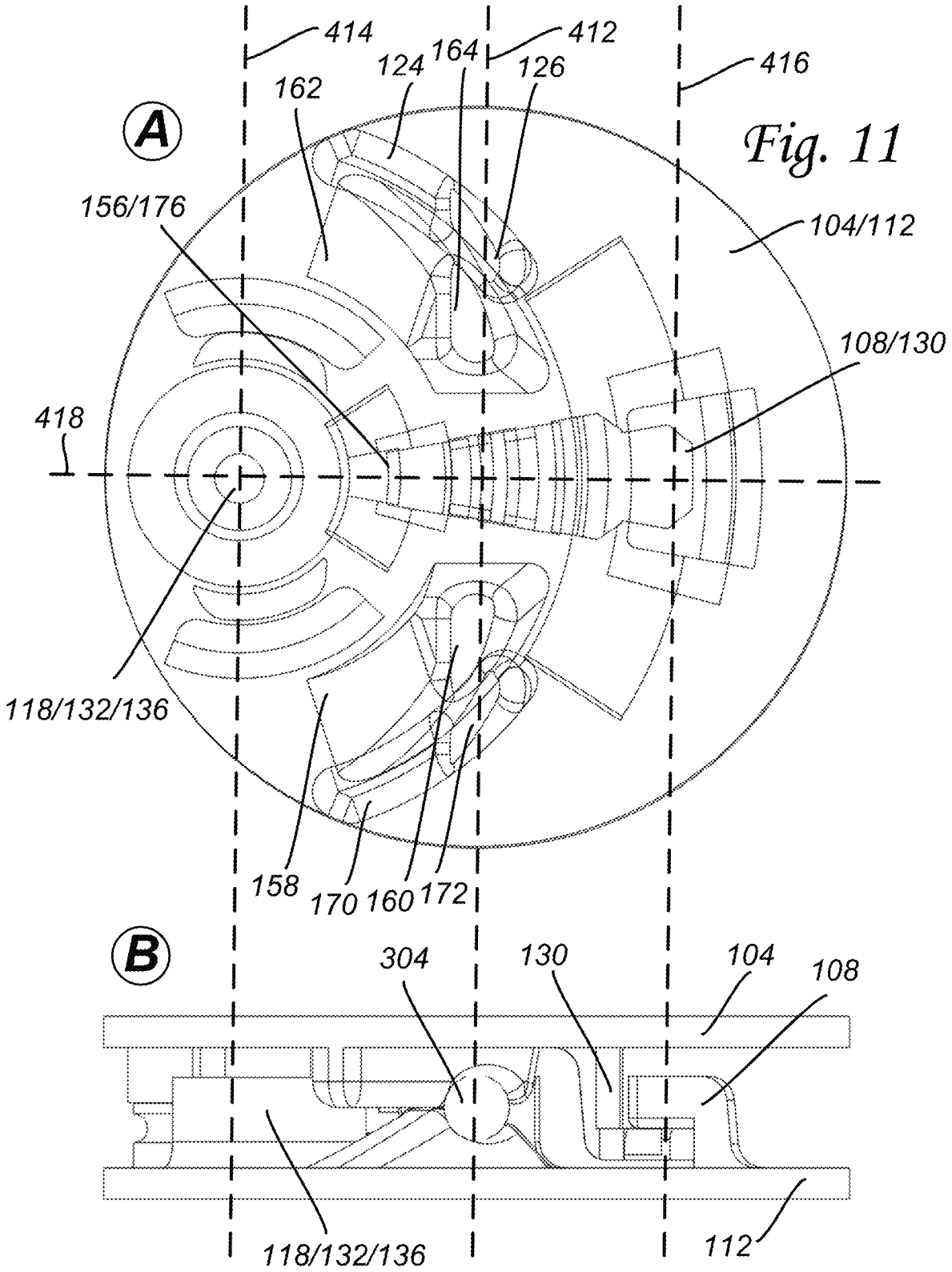
FIG. 11 illustrates one example of a front plate overlaid with a back plate showing interior component alignment.

In an exemplary embodiment and better illustrated in at least FIG. 11, when the clothing string clip 100 is in the closed position the contoured clothing string recessed channels 160/164 on the top plate 112 and the contoured clothing string recessed channels 126/172 on the back plate 104 are adjacent forming a constriction point between the contoured clothing string recessed channels 160/172 and 126/164 that pinches or otherwise friction grips the clothing string 304 therebetween. In operation, the clothing string 304 is tightly held in position within the interior region 152 of the clothing string clip 100.

Referring to FIG. 11 there is illustrated one example of a front plate 112 overlaid with a back plate 104 showing the interior component alignment. In FIG. 11, reference 'A' is a front view of the clothing string clip 100, and reference 'B' is a top view of the clothing string clip 100.

In an exemplary embodiment, when the clothing string clip 100 is in the closed position the front tab 108 and the back tab 130 interlock in a removable manner, pulling the front plate 112 and the back plate 104 closer together, constricting tightly the clothing string 304 between the contoured clothing string recessed channels 126/160/164/172.

In an exemplary embodiment, more than one set of front tabs 108/156 and more than one set of back tabs 130/176 can be utilized. In such an embodiment, when the clothing string clip 100 is in the closed position the front tab 108/156 and the back tabs 130/176 interlock in a removable manner, pulling the front plate 112 and the back plate 104 closer together, constricting tightly the clothing string 304 between the contoured clothing string recessed channels 126/160/164/172.

An advantage, in the present invention, of using such multiple front tabs 108/156 and back tabs 130/176 interconnection points is that a more even constricting force is maintained along the clothing string 304. Such even constricting force better prevents the front plate 112 and back plate 104 from bowing or otherwise separating unequally which can reduce the constricting force, also referred to as friction grip, on the clothing string 304. Such a reduction in constricting force can cause the clothing string to undesirably slip within the clothing string clip 100.

In this regard, in an exemplary embodiment, the clothing string clip 100 can comprise two of the front tabs 108/156 and two of the back tabs 130/176. When the clothing string clip 100 is in the closed position, one pair of the front tab 108 and the back tab 130 interlocks in a removable manner proximate to the mounting slot 114 and the back mounting slot 128, and one pair of the front tab 156 and the back tab 176 interlocks in a removable manner proximate to the orientation slot 116 and the back orientation slot 106, pulling the front plate 112 and the back plate 104 closer together, constricting tightly the clothing string 304 between the contoured clothing string recessed channels 126/160/164/172.

Additionally, in an exemplary embodiment, the front tabs 108/156 and back tabs 130/176 can be right-angled to expose an edge that engenders the front tabs 108/156 and back tabs 130/176 to overlap and more easily interlock or otherwise engage as they come into proximity of each other when the clothing string clip 100 is pivoted 404 closed.

In an exemplary embodiment, when the clothing string clip 100 is in a closed position the front tabs 108/156, the back tabs 130/176, and the rotatable hub 118/132/136 are aligned along a central reference line 418.

In an exemplary embodiment, the rotatable hub 118/132/136 is located 414 proximate to the perimeter of the front plate 114 and back plate 104 at one end of the central reference line 418 and the front tab 108 and the back tab 130 are located 416 proximate to the perimeter of the front plate 112 and the back plate 104 at the opposite end of the central reference line 418.

In an exemplary embodiment where additional front tab 156 and back tab 176 are used, the front tab 156 and the back tab 176 can be located 412 proximate to the center of the front plate 112 and the back plate 104 near the midpoint of the central reference line 418.

In an exemplary embodiment, the raised clothing string ridge 124/158/162/170 can be curvilinear is shape to increase their length and better align with each other. Additionally, the curvilinear shape of the raised clothing string ridge 124/158/162/170 allows the clothing string clip 100 to operate more smoothly with the rotational motion associated with the rotatable hub 118/132/136, and fit better on the back surfaces of the front plate 112 and back plate 104 with a circular shaped clothing string clip 100.

Figure 12:
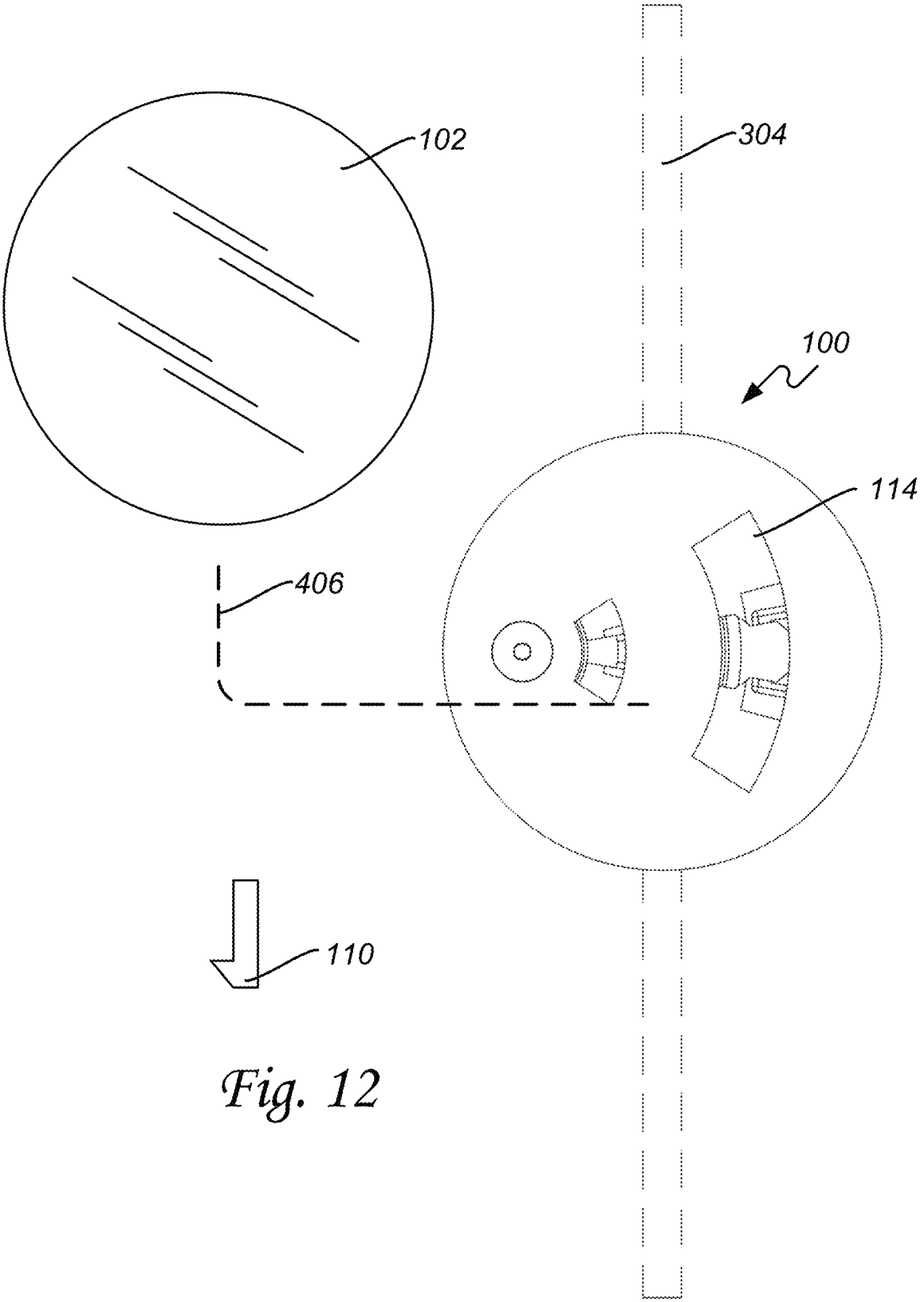
FIG. 12 illustrates one example of a front view of a clothing string clip with an emblem attachment.

Referring to FIG. 12 there is illustrated one example of a front view of a clothing string clip 100 with an emblem attachment. In an exemplary embodiment, the emblem 102 can comprise at least one clip 110 or other suitable size/shape/configuration clip 110 as better illustrated in at least FIG. 16 that can interconnect 406 with the mounting slot 114 to secure the emblem 102 to the front plate 112 or back plate 104 as may be required and/or desired in a particular embodiment.

In an exemplary embodiment, emblem 102 can be attached to the front plate 112 or back plate 104 by way of clip 110, adhesive, hook-and-loop, or other suitable methods as may be required and/or desired in a particular embodiment. In this regard, mounting slots 114/128 and orientation slots 106/116 can be utilized regardless of the method in which the emblem is fastened to the clothing string clip 100.

In another exemplary embodiment, the front plate 112 can comprise a mounting slot 114 and an orientation slot 116 where the emblem 102 can be fastened. In operation, the orientation slot 116 can be used to not only retain the emblem 102 but also to provide orientation allowing the emblem 102 to interconnect and fasten in only one location and in only one orientation on the surface of the front plate 112.

In a similar manner, in an exemplary embodiment and as better illustrated in at least FIG. 10, the back plate 104 can comprise a back mounting slot 128 where the emblem 102 can be fastened.

In another exemplary embodiment, the back plate 104 can comprise a back mounting slot 128 and a back orientation slot 106 where the emblem 102 can be fastened. In operation, the back orientation slot 106 can be used to not only retain the emblem 102 but also to provide orientation allowing the emblem 102 to interconnect and fasten in only one location and in only one orientation on the surface of the back plate 104.

As such, an emblem 102 can be attached to the outer surface of the back plate 104 by way of a back mounting slot 128. The back plate 104 can comprise the back mounting slot 128.

Additionally, an emblem 102 can be attached to the outer surface of the back plate 104 by way of a back mounting slot 128 and the back orientation slot 106. The back plate 104 can comprise the back mounting slot 128 and the back orientation slot 106.

In an exemplary embodiment, the mounting slot 114 and the back mounting slot 128 are different sizes to discriminate between which of the emblem 102 can be fastened on the front plate 112 and which of the emblem 102 can be fastened on the back plate 104. In this regard, the different-sized mounting slot 114 and back mounting slot 128 can be used to force which of the emblems 102 can be interconnected to the clothing string clip 102 including on which side (front plate 112 or back plate 104).

Figure 13:
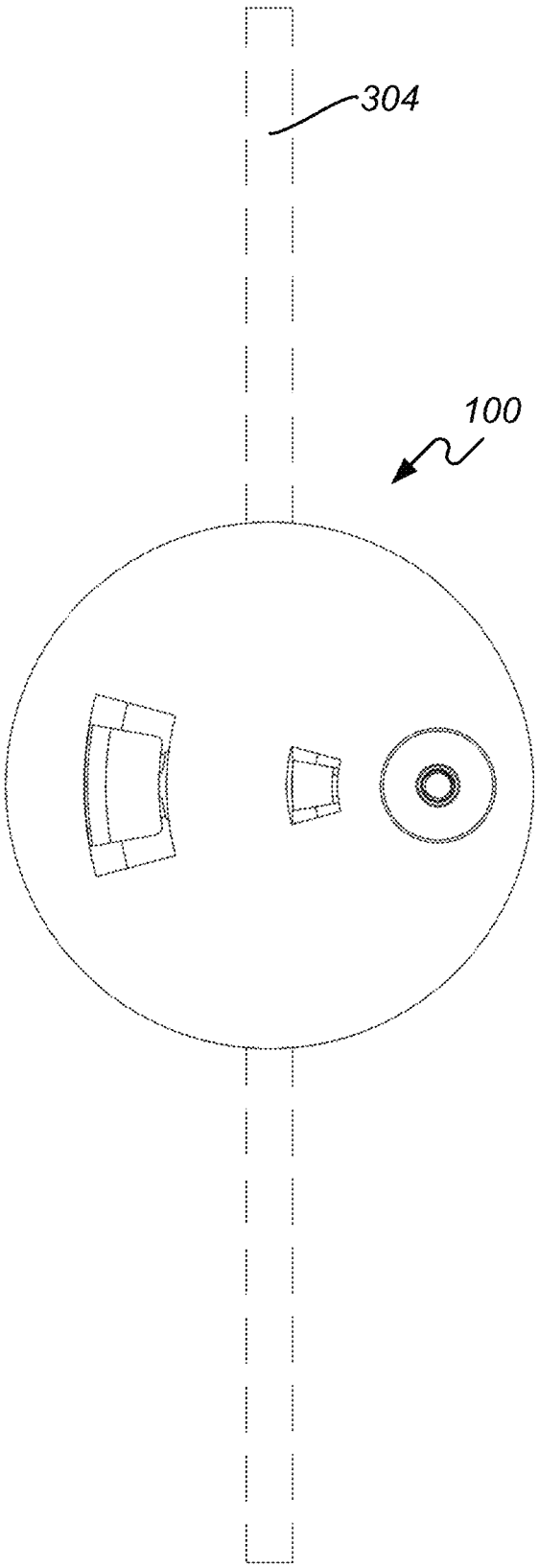
FIG. 13 illustrates one example of a back view of a clothing string clip.
Figure 14:
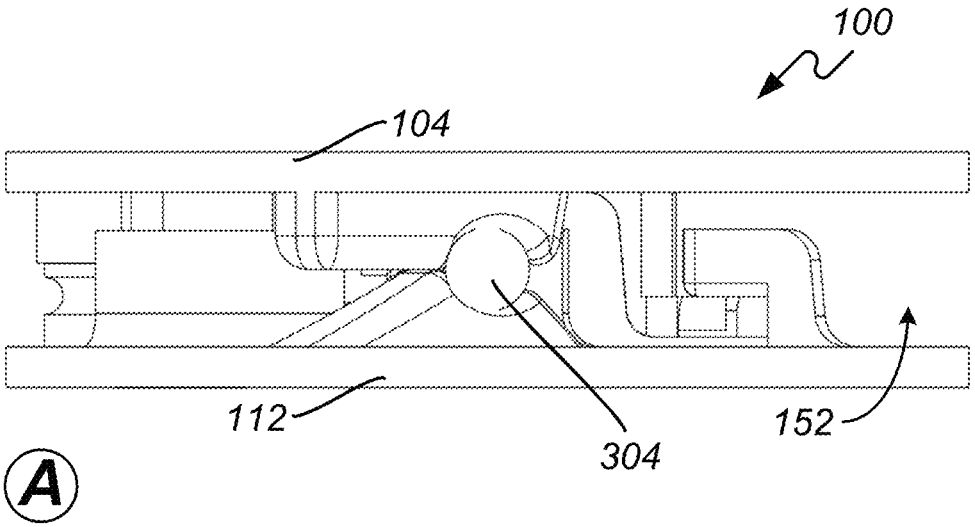
FIG. 14 illustrates one example of a top view and a bottom view of a clothing string clip.
Figure 14:
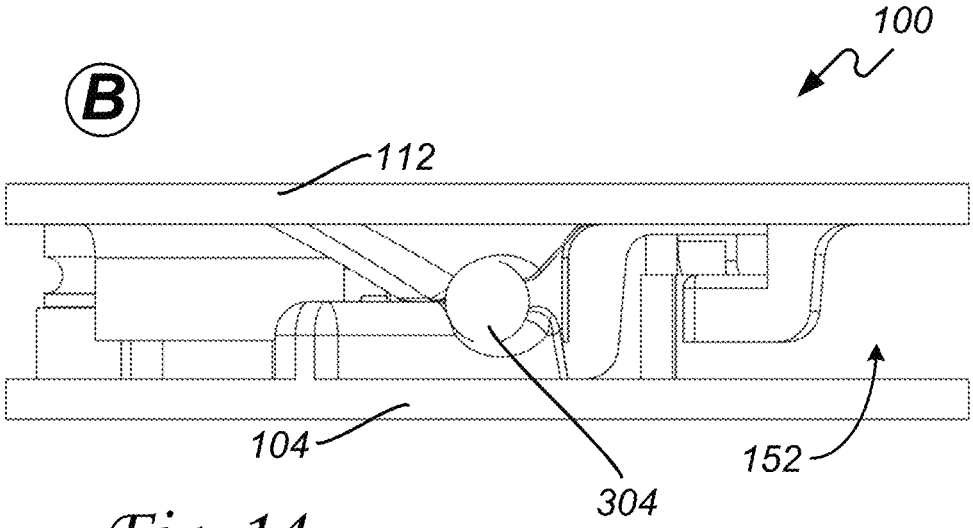
Figure 15:
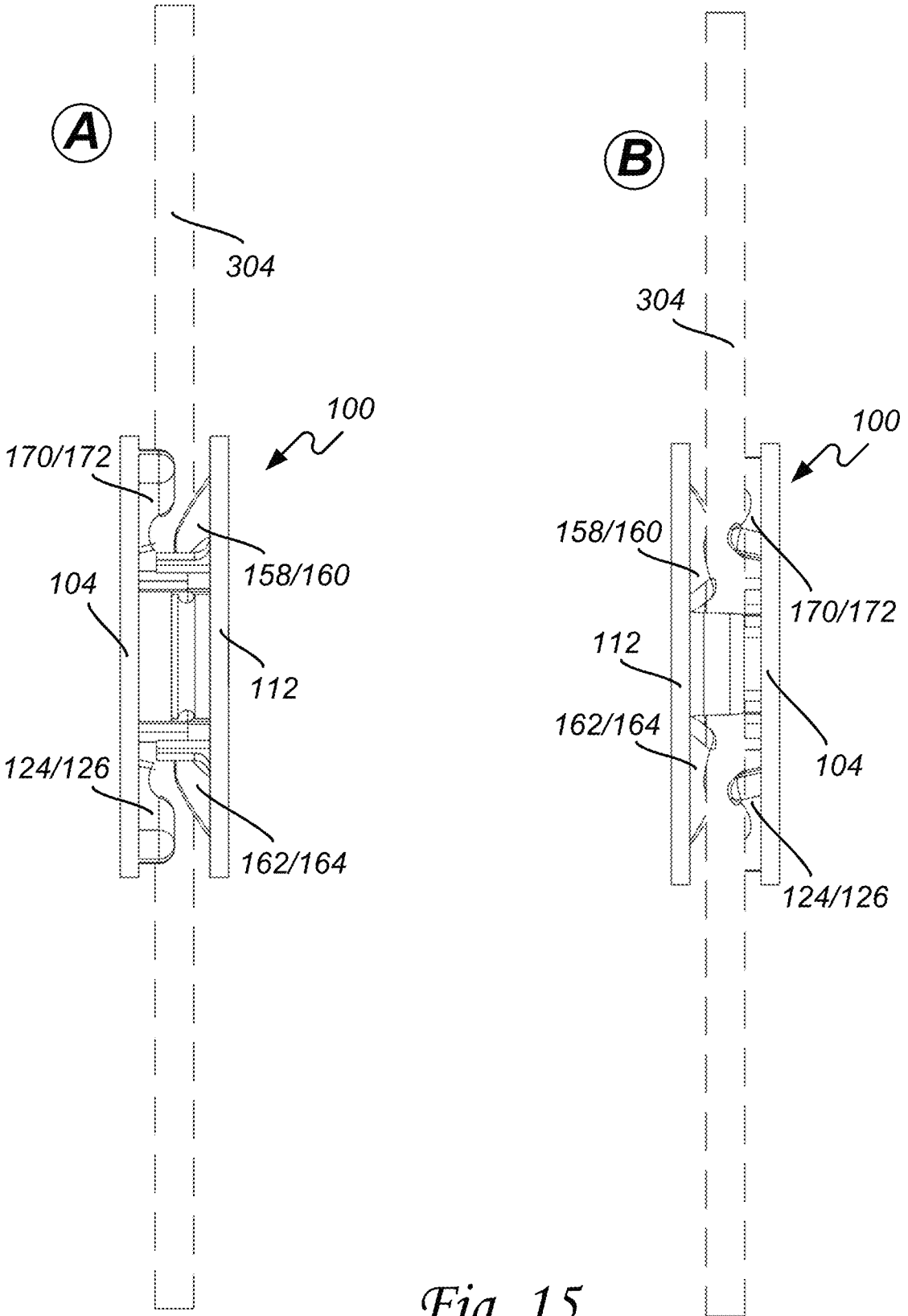
FIG. 15 illustrates one example of a left side view and a right side view of a clothing string clip.

Referring to FIG. 13 there is illustrated one example of a back view of a clothing string clip 100. Referring to FIG. 14 there is illustrated one example of a top view in reference 'A' and a bottom view in reference 'B' of a clothing string clip 100. And, referring to FIG. 15 there is illustrated one example of a left side view in reference 'A' and a right side view in reference 'B' of a clothing string clip 100.

In an exemplary embodiment, a clothing string clip 100 can be attached to clothing strings 304. In this regard, the clothing string clip 100 can comprise more than one raised clothing string ridge 124/158/162/170 each having a contoured clothing string recessed channel 126/160/164/172 along a portion of the peak of the raised clothing string ridge 124/158/162/170.

The clothing string clip 100 further comprises a front plate 112 having a mounting slot 114, and a hub hole 138. The back side of the front plate 112 comprises at least one front tab 108, at least one clothing string channel 166, at least one raised spring ridge 148/150 forming a spring recess 180, and more than one of the raised clothing string ridges 158/162. At least one of the raised clothing string ridges 158/162 is positioned on each side of the clothing string channel 166.

The clothing string clip 100 further comprises a back plate 104 having an insert hole 146. The back side of the back plate 104 comprises at least one back tab 130, at least one clothing string channel pressure tab 174, a spring seat 140/142/182, and more than one of the raised clothing string ridges 124/170. At least one of the raised clothing string ridges 124/170 is positioned on each side of the clothing string channel pressure tab 174. An insert 136 can be fitted into the insert hole 146.

The clothing string clip 100 further comprises a spring 132 that is positioned on the spring seat 140/142/182 and fitted into the spring recess 180. A fastener 118 passes through the hub hole 138 and fastens with the insert 136 securing the front plate 112 and the back plate 104 together forming a rotatable hub 118/132/136. The back side of the front plate 112 and the back side of the back plate 104 are opposed forming an interior region 152. An emblem 102 can be secured by way of the mounting slot 114 to the outer surface of the front plate 112.

In operation, user 202 can pivot 404 the rotatable hub 118/132/136 opening the front plate 112 with respect to the back plate 104. In the open position, a portion of the interior region 152 is exposed including at least the contoured clothing string recessed channels 126/160/164/172. The user 202 can insert a clothing string 304 across the contoured clothing string recessed channels 126/160/164/172 and into the clothing string channel 166.

The user 202 can then release the top plate 112. The spring 132 pivots 404 the rotatable hub 118/136/136, aligning the top plate 112 and the back plate 104 closed. In the closed position, the front tab 108 and the back tab 130 interlock in a removable manner pulling the front plate 112 and the back plate 104 together. The clothing string clip 100 constricts and friction grips the clothing string 304 within the contoured clothing string recessed channels 126/160/164/172, and the clothing string channel pressure tab 174 aligns within the clothing string channel 166, retaining the clothing string 304 within the clothing string channel 116 and applying pinch pressure to the clothing string 304 against back side of the front plate 112 by way of the clothing string channel pressure tab 174, abating slipping of the clothing string clip 100 along the clothing string 304 during use by user 202.

Figure 16:
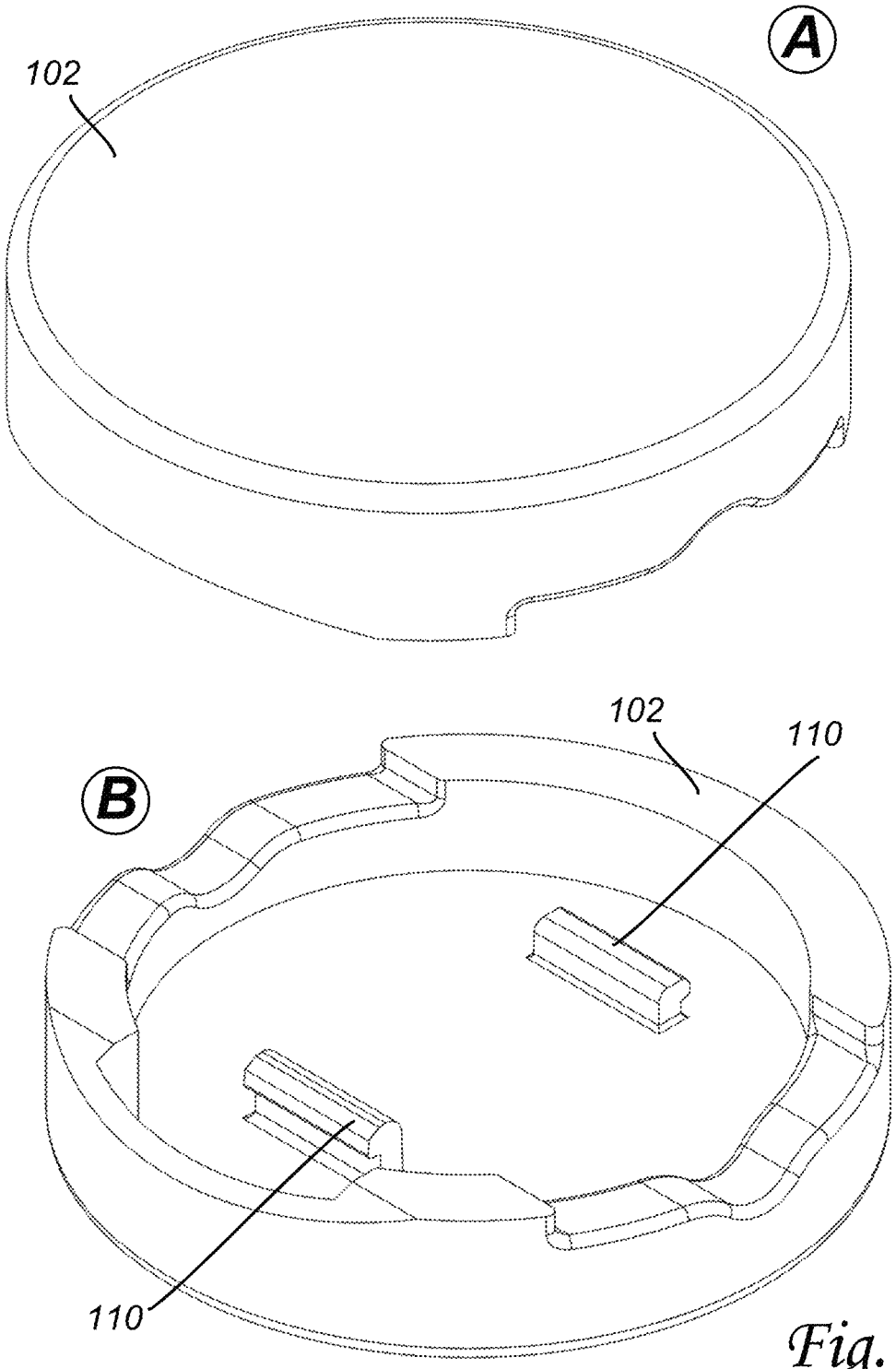
FIG. 16 illustrates one example of an emblem.

Referring to FIG. 16 illustrates one example of a top perspective view in reference 'A' and a back perspective view in reference 'B'. In an exemplary embodiment, emblem 102 can be secured by way of clips 110 to the mounting slot 114 on the outer surface of the front plate 112 and/or the back mounting slot 128 on the outer surface of the back plate 104 as may be required and/or desired in a particular embodiment.

Figure 17:
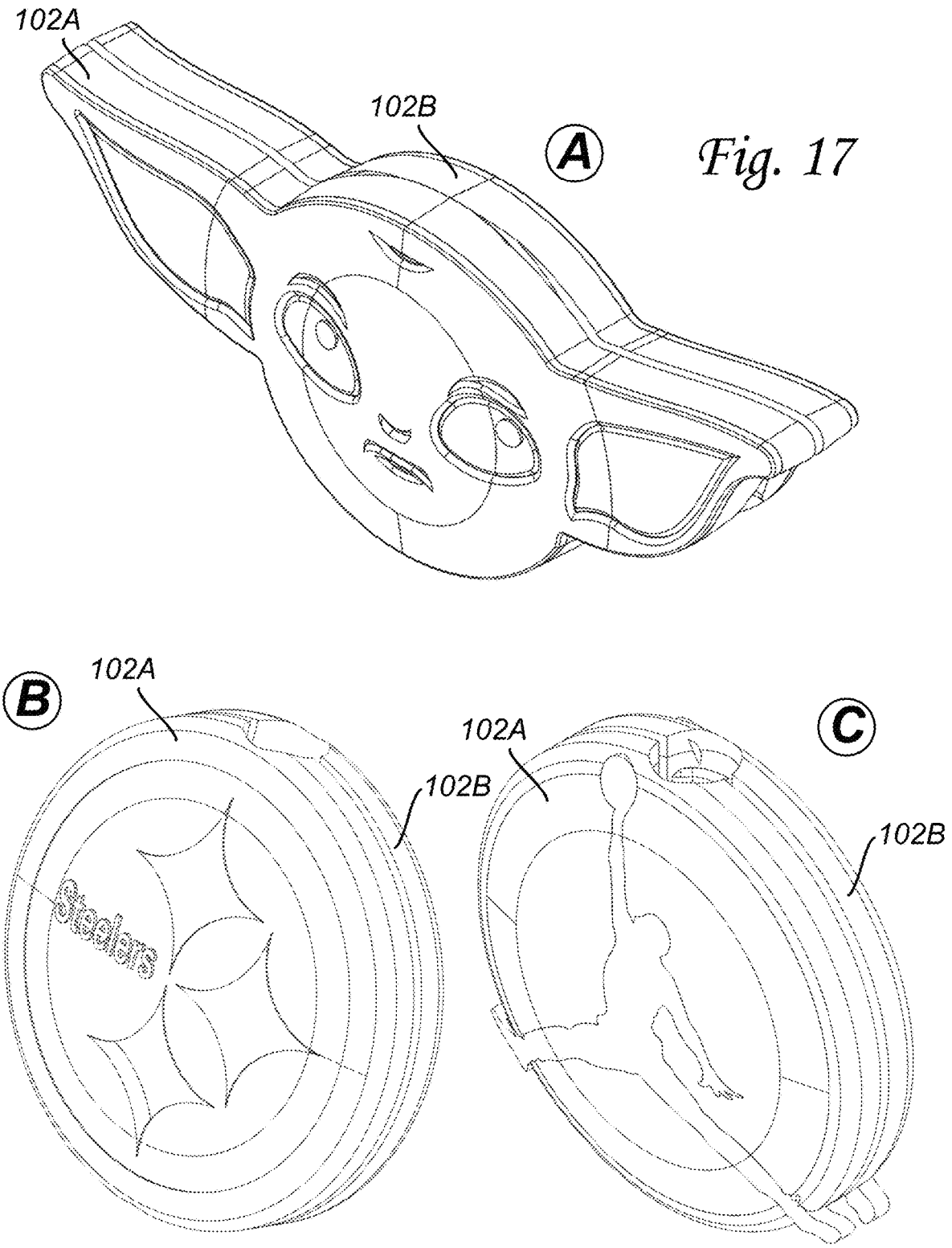
FIG. 17 illustrates exemplary embodiments of emblems.

Referring to FIG. 17 there are illustrated exemplary embodiment of emblems that can be interchangeably used in the present invention. For example, and not a limitation, in reference 'A' a pair of animal or wildlife emblems 102A and 102B can be secured to the front plate 112 and the back plate 104. In reference 'B' a pair of team or logo emblems 102A and 102B can be secured to the front plate 112 and the back plate 104. And, in reference 'C' a pair of sport or athletic emblems 102A and 102B can be secured to the front plate 112 and the back plate 104.

Figure 18:
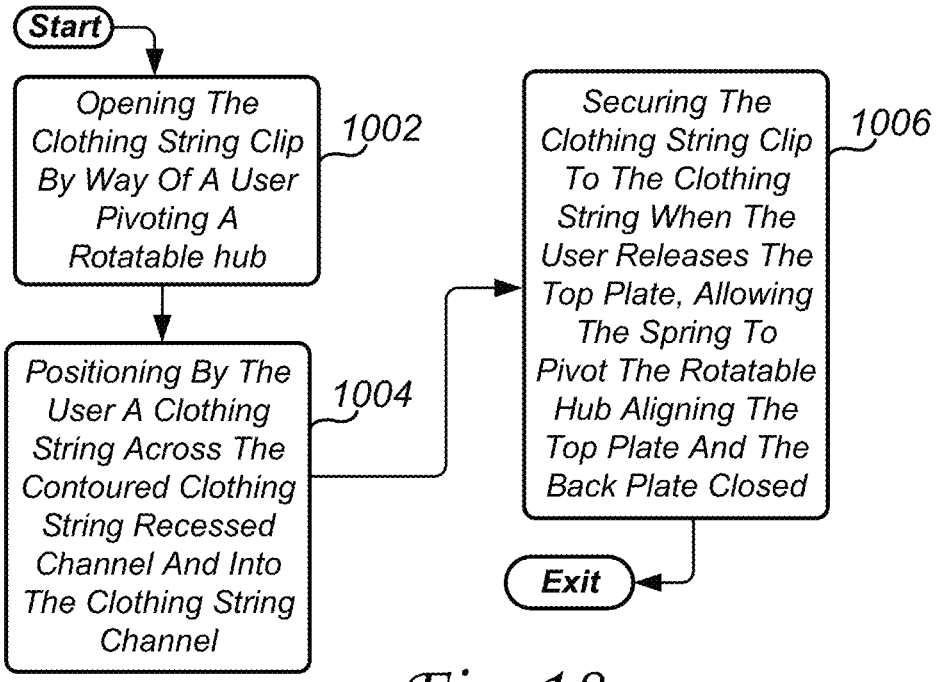
FIG. 18 illustrates one example of a method of using a clothing string clip that attaches to clothing strings.

Referring to FIG. 18 there is illustrated one example of a method of using a clothing string clip that attaches to clothing strings. In an exemplary embodiment, the method begins in step 1002.

In step 1002, the clothing string clip 100 is opened by way of user 202 pivoting a rotatable hub 118/132/136. The clothing string clip 100 comprises more than one raised clothing string ridge 124/158/162/170 having a contoured clothing string recessed channel 126/160/164/172 along a portion of the peak of the raised clothing string ridge 124/158/162/170. A front plate 112 has a mounting slot 114, and a hub hole 138. The back side of the front plate 112 comprises at least one front tab 114/116, at least one clothing string channel 166, at least one raised spring ridge 148/150 forming a spring recess 180, and more than one raised clothing string ridge 158/162. At least one raised clothing string ridge 158/162 is positioned on each side of the clothing string channel 166.

A back plate 104 has an insert hole 146. The back side of the back plate 104 comprises at least one back tab 130, at least one clothing string channel pressure tab 174, a spring seat 182, and more than one of the raised clothing string ridges 124/170. At least one raised clothing string ridge 127/170 is positioned on each side of the clothing string channel pressure tab 174. An insert 136 is fitted into the insert hole 146, and a spring 132 is positioned on the spring seat 140/142/182 and fitted into the spring recess 180.

A fastener 118 passes through the hub hole 138 and fastens with the insert 136 securing the front plate 112 and the back plate 104 together forming the rotatable hub 118/132/136. The back side of the front plate 112 and the back side of the back plate 104 are opposed forming an interior region 152.

In operation, user 202 opens the front plate 112 with respect to the back plate 10. The open position exposes a portion of the interior region 152 including at least the contoured clothing string recessed channels 126/160/164/172. The method then moves to step 1004.

In step 1004, a clothing string 304 is positioned by user 202 across the contoured clothing string recessed channels 126/160/164/172 and into the clothing string channel 166. The method then moves to step 1006.

In step 1006, the clothing string clip 100 is secured to the clothing string 304 when user 202 releases the top plate 112, allowing the spring 132 to pivot 404 the rotatable hub 118/132/136, aligning the top plate 112 and the back plate 104 closed. In the closed position, the clothing string clip 100 constricts and friction grips the clothing string 304 within the contoured clothing string recessed channels 126/160/164/172, and the clothing string channel pressure tab 174 aligns within the clothing string channel 166, retaining the clothing string 304 within the clothing string channel 166 and applying pinch pressure to the clothing string 304 against back side of the front plate 112 by way of the clothing string channel pressure tab 174, abating slipping of the clothing string clip 100 along the clothing string 304 during use by user 202. The method is then exited.

Figure 19:
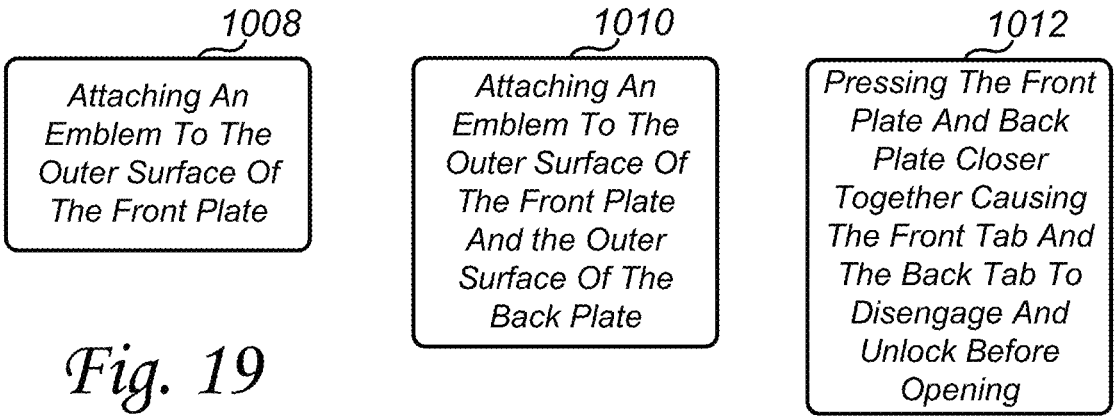
FIG. 19 illustrates exemplary embodiments that can be interchangeably used with the methods of the present invention.

Referring to FIG. 19 there are illustrated exemplary embodiments that can be interchangeably used with the methods of the present invention.

In step 1008, an emblem 102 can be attached to the outer surface of the front plate 112 by way of the mounting slot 114.

In step 1010, an emblem 102 can be attached to the outer surface of the front plate 112 by way of the mounting slot 114 and an emblem 102 can be attached to the outer surface of the back plate 104 by way of a back mounting slot 128. The back plate 104 comprises the back mounting slot 128.

In step 1012, the front plate 112 and the back plate 104 can be pressed closer together causing the front tab 103 and the back tab 130 to disengage and unlock allowing the front plate 112 to be pivoted open with respect to the back plate 104.

The flow diagrams depicted herein are just examples. There may be many variations to these diagrams or the steps (or operations) described therein without departing from the spirit of the invention. For instance, the steps may be performed in a differing order, or steps may be added, deleted, or modified. All of these variations are considered a part of the claimed invention.

While the preferred embodiment of the invention has been described, it will be understood that those skilled in the art, both now and in the future, may make various improvements and enhancements which fall within the scope of the claims which follow. These claims should be construed to maintain the proper protection for the invention first described.

What is claimed is:

1. A clothing string clip that attaches to clothing strings, the clothing string clip comprising:

more than one raised clothing string ridge each having a contoured clothing string recessed channel along a portion of the peak of the more than one raised clothing string ridge;

a front plate having a mounting slot, and a hub hole, a back side of the front plate comprises at least one front tab, at least one clothing string channel, at least one raised spring ridge forming a spring recess, and more than one of the more than one raised clothing string ridge, at least one of the more than one raised clothing string ridge is positioned on each side of the at least one clothing string channel;

a back plate having an insert hole, back side of the a back plate comprises at least one back tab, at least one clothing string channel pressure tab, a spring seat, and more than one raised clothing string ridge, at least one of the more than one raised clothing string ridge is positioned on each side of the at least one clothing string channel pressure tab;

an insert is fitted into the insert hole; and a spring is positioned on the spring seat and fitted into the spring recess, a fastener passes through the hub hole and fastens with the insert securing the front plate and the back plate together forming a rotatable hub, the back side of the front plate and the back side of the back plate are opposed forming an interior region;

wherein when a user pivots the rotatable hub, opening the front plate with respect to the back plate, an open position exposes a portion of the interior region including at least the contoured clothing string recessed channel, when the user inserts a clothing string across the contoured clothing string recessed channel and into the at least one clothing string channel;

wherein the user releases the top plate, the spring pivots the rotatable hub, aligning the top plate and the back plate closed, in a closed position the clothing string clip constricts and friction grips the clothing string within the contoured clothing string recessed channel and the at least one clothing string channel, abating slipping of the clothing string clip along the clothing string during use by the user.

2. The clothing string clip in accordance with claim 1, further comprising:

an emblem is secured by way of the mounting slot to an outer surface of the front plate.

3. The clothing string clip in accordance with claim 2, the emblem comprises at least one clip that interconnects with the mounting slot.

4. The clothing string clip in accordance with claim 2, the back plate comprises a back mounting slot where the emblem can be fastened.

5. The clothing string clip in accordance with claim 4, the mounting slot and the back mounting slot are different sizes to discriminate between which of the emblem can be fastened on the front plate and which of the emblem can be fastened on the back plate.

6. The clothing string clip in accordance with claim 1, further comprising:

an emblem is secured by way of the mounting slot and an orientation slot to outer surface of the front plate, the front plate further comprises the orientation slot.

7. The clothing string clip in accordance with claim 6, the back plate comprises a back mounting slot and a back orientation slot where the emblem can be fastened.

8. The clothing string clip in accordance with claim 7, the clothing string clip comprises two of the at least one front tab and two of the at least one back tab, when the clothing string clip is in the closed position one pair of the at least one front tab and the at least one back tab interlock in removable manner proximate to the mounting slot and the back mounting slot, and one pair of the at least one front tab and the at least one back tab interlock in a removable manner proximate to the orientation slot and the back orientation slot, pulling the front plate and the back plate together, constricting tightly the clothing string between the contoured clothing string recessed channel.

9. The clothing string clip in accordance with claim 1, when the clothing string clip is in the closed position the contoured clothing string recessed channel on the top plate and back plate are aligned along a central reference line allowing the clothing string to pass in gripping manner centrally through the interior region of the clothing string clip.

10. The clothing string clip in accordance with claim 9, when the clothing string clip is in the closed position the contoured clothing string recessed channel on the top plate and the contoured clothing string recessed channel on the back plate are adjacent forming a constriction point between the contoured clothing string recessed channel that pinches the clothing string therebetween, wherein the clothing string is tightly held in position within the interior region of the clothing string clip.

11. The clothing string clip in accordance with claim 1, when the clothing string clip is in the closed position the at least one front tab and the at least one back tab interlock in removable manner pulling the front plate and the back plate together constricting tightly the clothing string between the contoured clothing string recessed channel.

12. The clothing string clip in accordance with claim 11, when the clothing string clip is in the closed position the at least one front tab, the at least one back tab, and the rotatable hub are aligned along a central reference line.

13. The clothing string clip in accordance with claim 12, the rotatable hub is located proximate to perimeter of the front plate and back plate at one end of the central reference line and the at least one front tab and the at least one back tab are located proximate to perimeter of the front plate and the back plate at opposite end of the central reference line.

14. The clothing string clip in accordance with claim 1, when the clothing string clip is in the closed position the at least one front tab and the at least one back tab interlock requiring the front plate and the back plate to be pressed closer together to disengage and unlock the at least one front tab and the at least one back tab before the front plate can be pivoted open with respect to the back plate.

15. The clothing string clip in accordance with claim 1, the diameter of the spring seat is configured to fit within diameter of the spring recess retaining the spring therein when the front plate and back plate are fastened together.

16. The clothing string clip in accordance with claim 1, when the clothing string clip is in the closed position the clothing string clip friction grips the clothing string within the contoured clothing string recessed channel, and the at least one clothing string channel pressure tab aligns within the at least one clothing string channel, retaining the clothing string within the at least one clothing string channel and applying pinch pressure to the clothing string against back side of the front plate, abating slipping of the clothing string clip along the clothing string during use by the user.

17. A method of using a clothing string clip of claim 1, the method comprising the steps of:

opening the clothing string clip by way of a user pivoting the rotatable hub;

positioning, by way of the user, a clothing string across the contoured clothing string recessed channel and into the at least one clothing string channel; and securing the clothing string clip to the clothing string when the user releases the top plate, allowing the spring to pivot the rotatable hub, aligning the top plate and the back plate closed, in closed position the clothing string clip constricts and friction grips the clothing string within the contoured clothing string recessed channel, and the at least one clothing string channel pressure tab aligns within the at least one clothing string channel, retaining the clothing string within the at least one clothing string channel and applying pinch pressure to the clothing string against back side of the front plate by way of the at least one clothing string channel pressure tab, abating slipping of the clothing string clip along the clothing string during use by the user.

18. The method in accordance with claim 17, further comprising the step of:

attaching an emblem to an outer surface of the front plate by way of the mounting slot.

19. The method in accordance with claim 17, further comprising the step of:

attaching an emblem to outer surface of the front plate by way of the mounting slot and attaching an emblem to an outer surface of the back plate by way of a back mounting slot, the back plate comprises the back mounting slot.

20. The method in accordance with claim 17, the step of opening the clothing string clip further comprising:

pressing the front plate and the back plate closer together causing the at least one front tab and the at least one back tab to disengage and unlock allowing the front plate to be pivoted open with respect to the back plate.

21. A clothing string clip that attaches to clothing strings, the clothing string clip comprising:

more than one raised clothing string ridge cash having a contoured clothing string recessed channel along a portion of the peak of the more than one raised clothing string ridge;

a front plate having a mounting slot, and a hub hole, a back side of the front plate comprises at least one front tab, at least one clothing string channel, at least one raised spring ridge forming a spring recess, and more than one of the more than one raised clothing string ridge, at least one of the more than one raised clothing string ridge is positioned on each side of the at least one clothing string channel;

a back plate having an insert hole, a back side of the back plate comprises at least one back tab, at least one clothing string channel pressure tab, a spring seat, and more than one of the more than one raised clothing string ridge, at least one of the more than one raised clothing string ridge is positioned on each side of the at least one clothing string channel pressure tab;

an insert is fitted into the insert hole;

a spring is positioned on the spring seat and fitted into the spring recess, a fastener passes through the hub hole and fastens with the insert securing the front plate and the back plate together forming a rotatable hub, the back side of the front plate and the back side of the back plate are opposed forming an interior region; and an emblem is secured by way of the mounting slot to an outer surface of the front plate;

wherein when a user pivots the rotatable hub, opening the front plate with respect to the back plate, an open position exposes a portion of the interior region including at least the contoured clothing string recessed channel, the user inserts a clothing string across the contoured clothing string recessed channel and into the at least one clothing string channel;

wherein as when the user releases the top plate, the spring pivots the rotatable hub, aligning the top plate and the back plate closed, in a closed position the at least one front tab and the at least one back tab interlock in removable manner pulling the front plate and the back plate together, the clothing string clip constricts and friction grips the clothing string within the contoured clothing string recessed channel, and the at least one clothing string channel pressure tab aligns within the at least one clothing string channel, retaining the clothing string within the at least one clothing string channel and applying pinch pressure to the clothing string against back side of the front plate by way of the at least one clothing string channel pressure tab, abating slipping of the clothing string clip along the clothing string during use by the user.

22. The clothing string clip in accordance with claim 21, an emblem is attached to an outer surface of the back plate by way of a back mounting slot, the back plate comprises the back mounting slot.

23. The clothing string clip in accordance with claim 21, when the clothing string clip is in the closed position the at least one front tab and the at least one back tab interlock requiring the front plate and the back plate to be pressed closer together to disengage and unlock the at least one front tab and the at least one back tab before the front plate can be pivoted open with respect to the back plate.

* * * * *